US005354642A

United States Patent [19]

Texter et al.

[11] Patent Number: 5,354,642

[45] Date of Patent: * Oct. 11, 1994

[54] POLYMERIC COUPLERS FOR HEAT IMAGE SEPARATION SYSTEMS

[75] Inventors: John Texter, Rochester; Tienteh Chen, Penfield; Ronald H. White, Rochester, all of N.Y.

[73] Assignee: Eastman Kodak Company, Rochester, N.Y.

[ * ] Notice: The portion of the term of this patent subsequent to Dec. 14, 2010 has been disclaimed.

[21] Appl. No.: 927,691

[22] Filed: Aug. 10, 1992

[51] Int. Cl.[5] ..... G03C 5/54; G03C 7/32

[52] U.S. Cl. ..... 430/203; 430/351; 430/548; 430/226

[58] Field of Search ..... 430/203, 226, 201, 199, 430/548

[56] References Cited

U.S. PATENT DOCUMENTS

| | | | |
|---|---|---|---|
| 3,926,436 | 12/1975 | Monbaliu et al. . | |
| 4,080,211 | 3/1978 | Van Paesschen et al. . | |
| 4,215,195 | 7/1980 | Ponticello et al. . | |
| 4,455,363 | 6/1984 | Naito et al. | 430/548 |
| 4,474,870 | 10/1984 | Yagihara et al. . | |
| 4,511,647 | 4/1985 | Hirano et al. . | |
| 4,518,687 | 5/1985 | Hirano et al. . | |
| 4,522,916 | 6/1985 | Hirano . | |
| 4,576,910 | 3/1986 | Hirano et al. . | |
| 4,612,278 | 9/1986 | Lau et al. . | |
| 4,631,251 | 12/1986 | Komamura et al. | 430/226 |
| 4,650,748 | 3/1987 | Komamura et al. | 430/226 |
| 4,656,124 | 4/1987 | Komamura | 430/548 |
| 4,756,998 | 7/1988 | Helling et al. . | |
| 4,847,188 | 7/1989 | Komamura et al. | 430/203 |
| 4,874,689 | 10/1989 | Yamanouchi et al. . | |
| 4,921,782 | 5/1990 | Helling . | |
| 4,946,771 | 8/1990 | Maekawa et al. . | |
| 5,032,499 | 7/1991 | Kohno et al. | 430/203 |
| 5,164,280 | 11/1992 | Texter et al. | 430/235 |
| 5,270,145 | 12/1993 | Willis et al. | 430/203 |

FOREIGN PATENT DOCUMENTS

| | | |
|---|---|---|
| 0283938A1 | 9/1988 | European Pat. Off. . |
| 0316955A3 | 5/1989 | European Pat. Off. . |
| 0321399A3 | 6/1989 | European Pat. Off. . |
| 0259864B1 | 9/1991 | European Pat. Off. . |
| 4-73751 | 3/1992 | Japan . |
| 2092573B | 10/1984 | United Kingdom . |

*Primary Examiner*—Richard L. Schilling
*Attorney, Agent, or Firm*—Paul A. Leipold

[57] ABSTRACT

A process is disclosed for forming a dye image including the steps of:

exposing a photographic element comprising a support bearing a light sensitive silver halide emulsion layer containing a polymeric color coupler compound capable of forming a heat transferable dye upon development, wherein the polymeric color coupler compound is of the formula:

COUP-L-B wherein COUP represents a coupler moiety capable of forming a heat transferable dye upon reaction of the moiety with an oxidation product of a color developer; L is a divalent linking group which is separated from COUP upon reaction of the coupler moiety with said oxidation product of a color developer; and B represents the polymeric backbone;

developing said exposed element with a color developer solution to form a heat transferable dye image;

heating said exposed, developed element to thereby transfer the dye image from the emulsion layer to a dye receiving layer, where said receiving layer is part of the photographic element or part of a separate dye receiving element brought into contact with the photographic element; and separating the emulsion layer from the dye receiving layer containing the transferred dye image.

53 Claims, 3 Drawing Sheets

POLYMERIC COUPLERS FOR HEAT IMAGE SEPARATION SYSTEMS

This invention is related to copending, commonly assigned U.S. application Ser. No. 7/804,877, filed Dec. 6, 1991, *Heat Image Separation System* of Willis and Texter now U.S. Pat. No. 5,270,145, to U.S. application Ser. No. 7/804,868, filed Dec. 6, 1991, *Thermal Solvents for Dye Diffusion in Image Separation Systems* of Bailey et al., and to U.S. application Ser. No. 7/805,717, filed Dec. 6, 1991, *Mechanicochemcial Layer Stripping in Image Separation Systems* of Texter et al, now U.S. Pat. No. 5,164,280.

TECHNICAL FIELD

This invention relates to photographic systems and processes for forming a dye image in a light sensitive silver halide emulsion layer, and subsequently separating the dye image from the emulsion layer. More particularly, this invention relates to wet development processes for forming dye images in silver halide emulsion layers and to thermal dye diffusion image separation systems.

BACKGROUND INFORMATION

Wet Development—Dry Thermal Transfer Systems

In conventional "wet" silver halide based color photographic processing systems, an imagewise exposed photographic element, for example color paper designed to provide color prints, is processed in a color developer solution. The developer reduces the exposed silver halide of the photographic element to metallic silver and the resulting oxidized developer reacts with incorporated dye-forming couplers to yield dye images corresponding to the imagewise exposure. As silver is generally grey and desaturates the pure colors of the dyes, it is desirable to remove it from the dye images. Silver is conventionally separated from the dye images by a process of bleaching the silver to a silver halide and removing the silver halide by using an aqueous solvent, a fixing bath. This fixing bath also removes the undeveloped original silver halide. Commonly, the bleach and fix are combined into one solution, a bleach-fix solution.

Bleach-fix solutions commonly contain iron, ammonium, ethylenediaminetetraacetic acid, thiosulfate and, after use, silver. These components of "wet" silver halide processing are the source of much of the pollution from photo finishing processes. "Dry" silver halide based color photographic processing systems have been proposed which employ thermally developable color photographic material. Such thermally developable materials generally comprise a light sensitive layer containing silver halide, a photographic coupler or other dye-providing material, and a color developing agent as disclosed, e.g., in U. Pat. Nos. 4,584,267 and 4,948,698 and references cited therein. After image-wise exposure, these elements can be developed by uniformly heating the element to activate the developing agent incorporated therein, thereby eliminating the need for wet processing with a developer solution. In some thermally developable systems, the dye-providing materials are designed to form diffusible dyes upon heat development, which may be transferred to an image-receiving layer either during thermal development or thereafter in a separate step. Such thermally developable diffusion transfer color photography systems are disclosed in U. Pat. Nos. 4,584,267 and 4,948,698 referenced above.

These systems also eliminate the need for bleach-fix steps with processing solutions and the resulting effluent wastes.

Polymeric Couplers

It is also known in the art that couplers may be incorporated in the form of a polymer which improves the ability of the dye to remain in the location where it is formed in a color photographic element. For example, Monbaliu et al. disclose (U.S. Pat. No. 3,926,436) photographic elements containing polymeric couplers as latexes which show less foaming tendency and which show high compatibility with hydrophilic colloids such as gelatin. Yagihara et al. (U.S. Pat. No. 4,474,870) disclose photographic materials containing polymeric coupler latexes that form magenta dyes upon coupling with oxidized developing agents. Hirano et al. (U.S. Pat. No. 4,511,647) disclose color photographic materials containing cyan color forming coupler latexes. Yagihara et al. (U.K. Pat. No. 2,092,573 B) disclose silver halide photographic materials containing magenta color forming coupler latexes. Cawse and Harris (European Pat. Application 0321399 A3) disclose a method of preparing latexes of color couplers.

Generally, three methods have been employed in the past for dispersing polymeric couplers. These three methods include: (1) dispersing the coupler by colloid milling or homogenization methods, along with high and/or low vapor pressure organic solvents in aqueous surfactant and gelatin; (2) direct incorporation of solutions of water soluble polymers; (3) latex formation by emulsion polymerization or suspension polymerization.

Hirano (U.S. Pat. No. 4,522,916) discloses the preparation of polymeric magenta dye forming coupler latexes that provide images of improved light stability. Hirano discloses a series of magenta dye forming coupler monomers, wherein the coupling moieties are attached to the ethylenic group through a linking group attached to the coupling site. Hirano and Furutachi (U.S. Pat. No. 4,576,910) disclose the preparation of polymeric magenta dye forming coupler latexes formed from triazole and tetrazole monomers. Helling et al. (U.S. Pat No. 4,756,998) disclose the preparation of polymeric couplers which contain at least one urethane or urea group. Yamanouchi et al. (U.S. Pat. No. 4,874,689) disclose the preparation of polymeric couplers utilizing chain transfer agents of eight or more carbon atoms, and wherein the coupling moieties are attached to the ethylenic group through a linking group attached at the coupling site. Helling (U.S. Pat. No. 4,921,782) discloses the preparation of polymeric magenta dye forming couplers, wherein the magenta coupler monomer contains a carboxyl group. Maekawa and Hirano (U.S. Pat. No. 4,946,771) disclose the preparation of polymeric couplers formulated with certain advantageously incorporated coupling and noncoupling comonomers.

Sakanoue and Hirano (European Patent Application 0 259 864 A2) disclose the preparation of water-soluble yellow dye-forming polymeric couplers containing a repeating unit derived from at least one monomer in which the polymerization moiety is in a coupling-off group. Yamanouchi et al. (European Patent Application 0 316 955 A3) disclose several ethylenic coupling monomers wherein the coupling moieties are attached to the ethylenic group through a linking group attached to the coupling site. Hirano et al. (European Patent Application 0 283 938 A1) disclose polymeric couplers wherein the coupling moieties are attached to the polymeric backbone through linking groups that are attached to the coupling site.

Polymeric couplers can be prepared by joining reactive couplers to synthesized polymers. Such polymers may include polyacrylic acid, poly-p-aminostyrene, and other natural high polymers. Methods for producing such polymeric couplers are described in U.S. Pat. Nos. 2,698,797, 2,852,381, 2,852,383, and 2,870,712 and in Japanese Patent Publication Nos. 16932/1960 and 3661/1969. Methods for forming polymeric couplers from ethylenically unsaturated monomers and other polymerizable monomers are disclosed in British Pat. Nos. 880,206, 955,197, 967,503, 967,504, 995,363, and 1,104,658.

Jones disclosed (U.S. Pat. No. 2,561,205) the formation of water-soluble polymeric couplers derived from $\beta,\gamma$-ethylenically unsaturated amides. Williams disclosed (U.S. Pat. No. 2,739,956) the formation of water-soluble polymeric couplers derived from vinyl-substituted monomers such as 2-vinyl-1-naphthol. Firestine disclosed (U.S. Pat. No. 2,976,294) water-soluble polymers derived from methacrylamide related monomers, such as 1-(m-methacryloylaminophenyl)-2-carboxy-5-pyrazolone.

Umberger (U.S. Pat. No. 3,451,820) discloses dispersions of lipophilic colorforming polymeric couplers. Van Paesschen and Priem (U.S. Pat. No. 4,080,211) disclose a process for making color-coupling agents by emulsion polymerization. Ponticello et al. (U.S. Pat. No. 4,215,195) disclose the preparation of cross-linkable polymers that contain color-forming coupler residues. Hirano et al. (U.S. Pat. No. 4,518,687) disclose a photographic material containing a cyan dye-forming oleophilic polymeric coupler. Lau and Tang (U.S. Pat. No. 4,612,278) disclose photographic materials containing polymeric couplers copolymerized with alkoxyalkylacrylate monomers.

Problems

While dry processing systems as discussed above are beneficial in that they eliminate the need for processing solutions and the resulting waste, they require additional materials, such as developing agents, to be incorporated into the thermally developable photographic element itself. Also, the levels of silver halide necessary for heat developable systems are generally substantially higher than those required for conventional wet systems. The presence of such additional materials can detrimentally affect the cost, performance, and storage properties of such elements.

It would be desirable to provide a photographic processing system which would reduce the amount of waste processing solution effluents generated by the overall processing system while retaining the benefits of image quality and industry compatibility which are derived from wet development with conventional developing solutions.

A previously unrecognized problem in wet development/dry thermal transfer systems is that considerable quantities of coupler are routinely transferred to the receiver in addition to the dye. This thermal transfer of coupler is unwanted and undesirable because unwanted hue effects can result, the transferred coupler can result in unwanted printout as the result of chemical transformations of the transferred coupler, and the thermally transferred coupler can cause difficult to control anomalies in the thermal stability of the transferred dye and the glass transition temperature of the receiver element.

These and other problems may be overcome by the practice of our invention.

SUMMARY OF THE INVENTION

An object of the invention is to overcome disadvantages of prior processes. Another object of the invention is to provide dye images of improved hue. Yet another object is to provide heat transferable dyes while reducing or eliminating the presence of heat transferable coupling moieties. A further object is to provide improved coupling reactivity.

An object of the present invention is to provide coating melts of improved coatability. Another object is to provide photographic elements of increased storage stability. Yet another object is to provide a process for imaging that utilizes reduced quantities of noxious organic solvents in the dispersal of coupling moieties and to reduce the amount of organic solvents vented to the environment.

These and other objects of the invention are generally achieved by providing a process for forming a dye image comprising the steps of:

exposing a photographic element comprising a support bearing a light sensitive silver halide emulsion layer containing a polymeric color coupler compound capable of forming a heat transferable dye upon development, wherein the polymeric color coupler compound is of the formula:

COUP-L-B wherein COUP represents a coupler moiety capable of forming a heat transferable dye upon reaction of the moiety with an oxidation product of a color developer; L is a divalent linking group which is separated from COUP upon reaction of the coupler moiety with said oxidation product of a color developer; and B represents the polymeric backbone;

developing said exposed element with a color developer solution to form a heat transferable dye image;

heating said exposed, developed element to thereby transfer the dye image from the emulsion layer to a dye receiving layer, where said receiving layer is part of the photographic element or part of a separate dye receiving element brought into contact with the photographic element; and separating the emulsion layer from the dye receiving layer containing the transferred dye image.

DETAILED DESCRIPTION OF THE INVENTION

Figure 1:
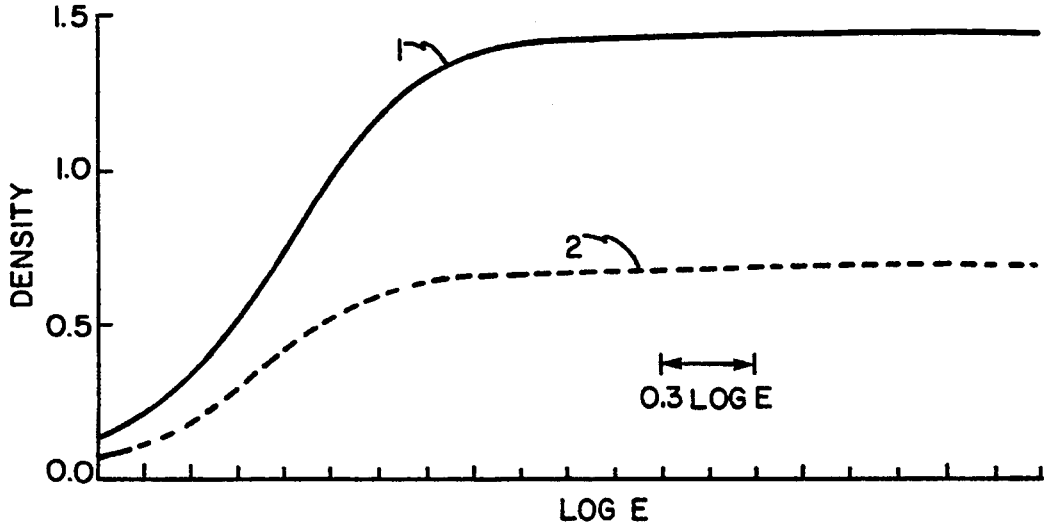
FIG. 1. Status A reflectance densitometry for test receiver elements obtained for the comparison coupler Y3 (curve 1) and for the polymeric coupler Y2 (curve 2) of the present invention.

While polymeric couplers are now well known in photographic applications, elements, and processes, their general use in the present invention is disadvantageous with respect to the formation of useful diffusion transfer dye images. This disadvantage stems from the fact that most polymeric couplers that have been disclosed react with the oxidation product of primary amine developing agents to produce image dyes, wherein said image dyes are not diffusible. This nondiffusibility stems from the basic nondiffusibility of the polymeric coupler, wherein said coupling moieties are usually attached to the polymeric backbone through a linking group that is not associated with the coupling site of the coupling moiety. Dyes which are formed by conventional color development and subsequent coupling chemistry remain attached to the polymeric backbone, and are therefore nondiffusible and unavailable for color diffusion transfer. However, an entirely different situation obtains for that class of polymeric couplers disclosed in the present invention, wherein said polymeric couplers comprise coupling moieties attached to the polymeric backbone through linking groups, wherein said linking groups are attached to the respective coupling sites. This subclass of polymeric couplers produces diffusible dyes upon reaction with the oxidation product of primary amine developing agents. Said dye-forming reactions sever the coupling moiety from the polymeric backbone.

Accordingly, the use of this special class of polymeric couplers affords numerous advantages in heat image separation systems as described herein. A particularly useful advantage is that the desired image dyes are formed and free to diffuse to receiver elements, while the coupler moieties that do not react to form dye remain nondiffusible. This separation of diffusibilities keeps coupler moieties out of the receiver elements and prevents dye hues from being influenced by the undesired transfer of coupler moieties. This use of polymeric couplers also results in advantageously improved coupling reactivity in many cases, wherein said improvements comprise obtaining higher dye densities. The use of polymeric couplers also results in coating melts with improved coatability; layers containing such polymeric couplers may be coated with less binder, which results in thinner layers, improved sharpness, and improved dye transfer efficiency. The use of polymeric couplers also results in improved storage stability of the coated photographic elements. This storage advantage obtains since conventional coupler dispersions, subject to crystallization as a result of thermodynamic metastability during storage, are replaced by polymeric couplers which cannot crystallize during storage. A further advantage from the use of the polymeric couplers of the present inventions is that the overall use of organic solvents in the dispersal of coupling moieties is reduced. Such solvents such as ethylacetate, cyclohexanone, and the like are routinely used in preparing conventional coupler dispersions for photographic elements, and they must be removed from said dispersions during manufacture of the elements. Said handling of said solvents imposes unwanted costs and unwanted operator exposure during manufacture. Such handling and exposure is largely eliminated by replacing such conventional coupler dispersions with the polymeric couplers of the present invention.

The coupler moiety of the polymeric coupler of formula (I) which is to be contained in the color photographic material to be used in the process of the invention is designed to be developable by conventional color developer solutions, and to form a heat transferable dye upon such conventional development. While color images may be formed with coupler compounds which form dyes of essentially any hue, couplers which form heat transferable cyan, magenta, or yellow dyes upon reaction with oxidized color developing agents are used in preferred embodiments of the invention.

COUP may represent a coupler moiety, capable of forming a cyan dye by coupling with an aromatic primary amine developing agent. Couplers which form cyan dyes upon reaction with oxidized color developing agents are described in such representative patents as U. Pat. Nos. 2,474,293, 2,772,162, 2,801,171, 2,895,826, 3,002,836, 3,419,390, 3,476,565, 3,779,763, 3,996,252, 4,124,396, 4,248,962, 4,254,212, 4,296,200, 4,333,999, 4,443,536, 4,457,559, 4,500,635, 4,526,864, and 4,874,689 and in European Patent Application No. 0 283 938 A1, the disclosures of which are incorporated by reference. Preferred coupler moieties COUP which form cyan dyes upon reaction with oxidized color developing agents are of the phenol type (formula C-I) or the naphthol type (formulae C-II and C-III) or of the type C-IV; the asterisk mark indicates the position of the bond to the divalent linking group L in formula (I)

C-I

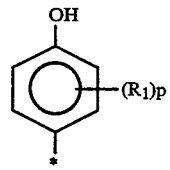

C-II

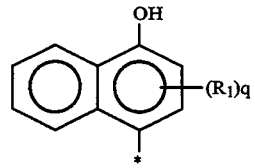

C-III

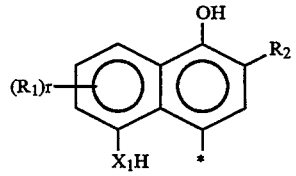

C-IV

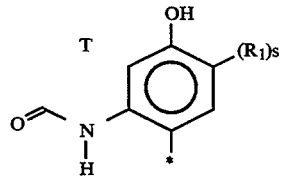

In formulae C-I, C-H, C-III, and C-IV above:

$R_1$ has 0 to 30 carbon atoms and represents a possible substituent on the phenol ring or naphthol ring. It is an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group, an arylureido group, hydroxyl group, amino group, carboxyl group, sulfo group, heterocylcic group, carbonamido group, sulfonamido group, carbamoyl group, sulfamoyl group, ureido group, acyloxy group, aliphatic oxy group, aliphatic thio group, aliphatic sulfonyl group, aromatic oxy group, aromatic thio group, aromatic sulfonyl group, sulfamoyl amino group, nitro group, or imido group.

$R_2$ represents $—CONR_3R_4$, $—NHCOR_3$, $—NHCOOR_5$, $NHSO_2R_5$, $—NHCONR_3R_4$, or $NHSO_2R_3R_4$, $R_3$ and $R_4$ each represent a hydrogen atom, aliphatic group having 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-t-amylphenoxy-propyl, and 2,4-di-t-amylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_5$ represents an aliphatic group having from 1 to 30 carbon atoms (such as methyl, ethyl, butyl, methoxyethyl, n-decyl, n-dodecyl, and n-hexadecyl), aromatic group having from 6 to 30 carbon atoms (such as phenyl, tolyl, 4-chlorophenyl, and naphthyl), or heterocyclic group (such as 2-pyridyl, 4-pyridyl, and 2-furyl). $R_3$ and $R_4$ may join each other to form a heterocyclic ring (such as morpholine ring, piperidine ring, and pyrrolidine ring); p is an integer form 0 to 3; q and r are integers from 0 to 4; s is an integer from 0 to 2.

$X_1$ represents an oxygen atom, sulfur atom, or $R_6N<$ group, where $R_6$ represents a hydrogen atom or monovalent group. When $R_6$ represents a monovalent group, it includes, for example, an aliphatic group having from 1 to 30 carbon atoms (such as methyl, ethyl, butyl, methoxyethyl, and benzyl), aromatic group having from 6 to 30 carbon atoms (such as phenyl and tolyl), heterocyclic group having from 2 to 30 carbon atoms (such as 2-pyridyl and 2-pyrimidyl), carbonamido group having from 1 to 30 carbon atoms (such as formamido, acetamido, N-methylacetamido, toluenesulfonamido, and 4-chlorobenzenesulfonamido), imido group having from 4 to 30 carbon atoms (such as succinimido), $—OR_7$, $—SR_7$, $—COR_7$. $—CONR_7R_8$, $—COCOR_7$, $—COCOR_7R_8$, $—COOR_7$, $—COCOOR_9$, $—SO_2R_9$, $—SO_2OR_9$, $—SO_2NR_7R_8$, or $—NR_7R_8$. $R_7$ and $R_8$, which may be the same or different, each represent a hydrogen atom, aliphatic group having from 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-t-amylphenoxypropyl, and 2,4-di-tamylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_7$ and $R_8$ may join each other to form a heterocyclic ring (such as morpholine group and piperidino group). $R_9$ may include, for example, those substituents (excluding a hydrogen atom) exemplified for $R_7$ and $R_8$.

T represents a group of atoms required to form a 5-, 6-, or 7-membered ring by connecting with the carbon atoms. It represents, for example $$—O—,\ —\underset{\underset{R'}{|}}{N}—,\ —\underset{\underset{O}{\|}}{C}—,\ —S—,\ —N=,\ =N—,$$

$$—\underset{\underset{R'}{|}}{C}=,\ =\underset{\underset{R'}{|}}{C}—,\ \text{or}\ —\overset{\overset{R'}{|}}{\underset{\underset{R''}{|}}{C}}—,$$

or a combination thereof. In the formulae above, R′ and R″ each represent a hydrogen atom, alkyl group, aryl group, halogen atom, alkyloxy group, alkyloxycarbonyl group, arylcarbonyl group, alkylcarbamoyl group, arylcarbamoyl group or cyano group.

The preferred substituent groups in the present invention are exemplified in the following:

$R_1$ includes a halogen atom (such as fluorine, chlorine, and bromine), aliphatic group (such as methyl, ethyl, and isopropyl), carbonamido group (such as acetamido and benzamido), and sulfonamido (such as methanesulfonamido and toluenesulfonamido).

$R_2$ includes $—CONR_3R_4$ (such as carbamoyl, ethylcarbamoyl, morpholinocarbonyl, dodecylcarbamoyl, hexadecylcarbamoyl, decyloxypropyl, dodecyloxypropyl, 2,4-di-tert-amylphenoxypropyl, and 2,4-di-t-amylphenoxybutyl). $X_1$ includes $R_6N<$, wherein $R_6$ is preferably $—COR_7$ (such as formyl, acetyl, trifluoroacetyl, benzoyl, pentafluorobenzoyl, and p-chlorobenzoyl), $—COOR_9$ (such as methoxycarbonyl, ethoxycarbonyl, butoxycarbonyl, dodecyloxycarbonyl, methoxyethoxycarbonyl, and phenoxycarbonyl), $—SO_2R_9$ (such as methanesulfonyl, ethanesulfonyl, butanesulfonyl, hexadecanesulfonyl, benzenesulfonyl, toluenesulfonyl, and p-chlorobenzensulfonyl), $—CONR_7R_8$ (such as N,N-dimethyl carbamoyl, N,N-diethylcarbamoyl, N,N-dimethylcarbamoyl, N,N-diethylcarbamoyl, N,N-dibutylcarbamoyl, morpholinocarbonyl, piperidinocarbonyl, 4-cyanophenylcarbamoyl, 3,4-dichlorophenylcarbamoyl, and 4-methanesulfonylphenylcarbamoyl, and N,N-dibutylcarbamoyl), and $—SO_2NR_7R_8$ (such as N,N-dimethylsulfamoyl, N,N-diethylsulfamoyl, and N,N-dipropylsulfamoyl). Particularly preferred examples of $R_6$ are those groups represented by $—COR_7$, $—COOR_9$, and $—SO_2R_9$.

$R_1$ may be substituted. Preferred substituents are aryl groups (such as phenyl), nitro group, hydroxy group, cyano group, sulfo group, an alkoxy group (such as methoxy), an aryloxy group (such as phenoxy), an acyloxy group (such as acetoxy), an acylamino group (such as aetylamino), an alkylsufonamido group (such as methanesulfonamido), an alkylsulfamoyl group (such as fluorine atom, chlorine atom, bromine atom), carboxyl group, an alkylcarbamoyl group (such as methylcarbamoyl), an alkoxycarbonyl group (such as methoxycarbonyl), an alkylsulfonyl group (such as methylsulfonyl), an alkylthio group (such as β-carboxyethylthio), etc. In the case that said group is substituted by two or more of said substituents, these substituents may be the same or different.

Preferred examples of divalent linking groups L, to use in combination with cyan dye forming coupler moieties, include —O—, —NH—, —S—, substituted and unsubstituted phenoxy, alkoxy, —NH—$SO_2$—, and —N=N—.

Preferred examples of cyan dye forming coupler monomers comprising preferred COUP and L moieties include the following:

c-i

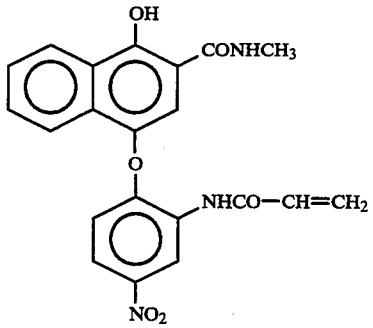

c-ii

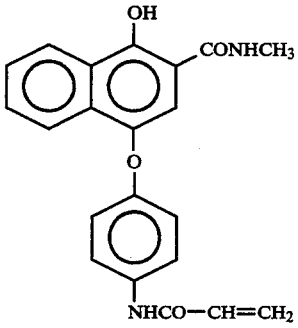

c-iii

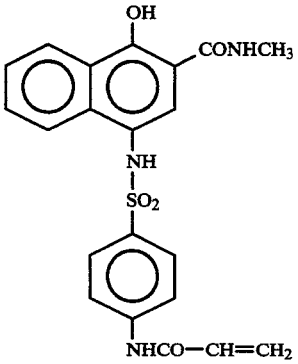

c-iv

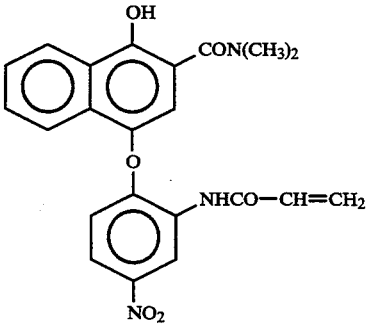

c-v

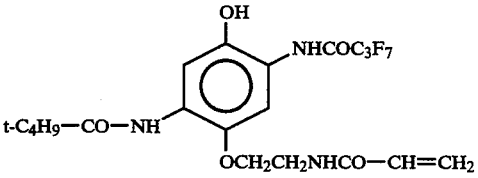

-continued c-vi

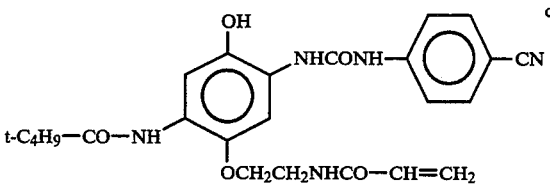

c-vii

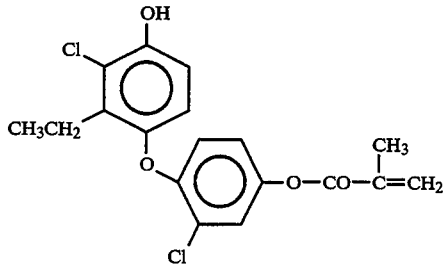

c-viii

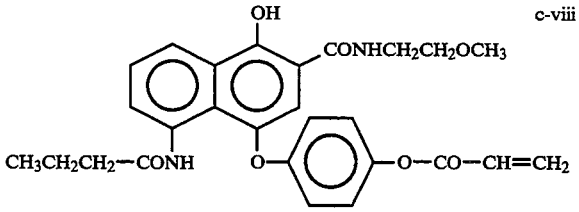

COUP may represent a coupler moiety, capable of forming a magenta dye by coupling with an aromatic primary amine developing agent. Couplers which form magenta dyes upon reaction with oxidized color developing agents are described in such representative patents and publications as U.S. Pat. Nos. 1,969,479, 2,311,082, 2,343,703, 2,369,489, 2,600,788, 2,908,573, 3,061,432, 3,062,653, 3,152,896, 3,519,429, 3,725,067, 4,120,723, 4,500,630, 4,522,916, 4,540,654, 4,581,326, and 4,874,689, and European Patent Publications Nos. 0 170 164, 0 177 765, 0 283 938 A1, and 0 316 955 A3, the disclosures of which are incorporated by reference. Preferred magenta couplers include pyrazolones, pyrazolotriazole, and pyrazolobenzimidazole compounds which can form heat transferable dyes upon reaction with oxidized color developing agent. Preferred coupler moieties COUP which form magenta dyes upon reaction with oxidized color developing agents are of the pyrazolotriazole-type and imidazopyrazole-type (formulae M-I to M-VII); the asterisk mark indicates the position of the bond to the divalent linking group L in formula (I)

M-I

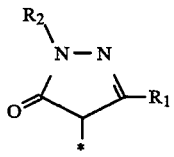

M-II

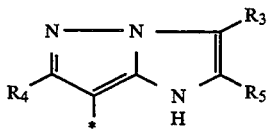

-continued

M-III

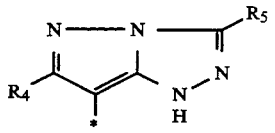

M-IV

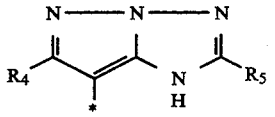

M-V

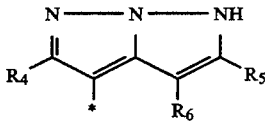

M-VI

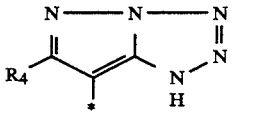

M-VII

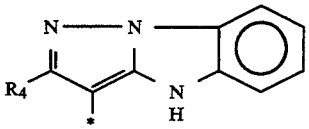

In formulae M-I, M-II, M-III, M-IV, M-V, M-VI, and M-VII above:

$R_1$ and $R_2$ each independently represent a conventional substituent which is well known as a substituent on the 1-position or on the 3-position of a 2-pyrazolin-5-one coupler, such as an alkyl group, a substituted alkyl group (such as a halo-alkyl group, e.g., fluoroalkyl, or cyano-alkyl, or benzyl-alkyl), an aryl group or a substituted aryl group (e.g., methyl or ethyl substituted), an alkoxy group (such as methoxy or ethoxy), an aryloxy group (such as phenyloxy), an alkoxycarbonyl group (such as methoxy carbonyl), an acylamino group (such as acetylamino), a carbamoyl group, an alkylcarbamoyl group (such as methylcarbamoyl or ethylcarbamoyl), a dialkylcarbamoyl group (such as dimethylcarbamoyl), an arylcarbamoyl group (such as phenylcarbamoyl), an alkylsulfonyl group (such as methylsulfonyl), an arylsufonyl group (such as phenylsulfonyl), an alkylsulfonamido group (such as methanesulfonamido), an arylsulfonmnido group (such as phenylsulfonamido), a sulfamoyl group, an alkylsulfamoyl group (such as ethylsulfamoyl), a dialkylsulfamoyl group (such as dimethylsulfamoyl), an arylsulfamoyl group, an alkylthio group (such as methylthio), an arylthio group (such as phenylthio), cyano group, nitro group, a halogen atom (such as fluorine atom, chlorine atom, bromine atom), etc. In case said group is substituted by two or more of said substituents, these may be the same or different. The most preferred substituents are a halogen atom, an alkyl group, an alkoxy group, an alkoxycarbonyl group, and the cyano group.

$R_3$, $R_4$, $R_5$, and $R_6$ are each independently a hydrogen atom or hydroxyl group, or represent an unsubstituted or substituted alkyl group (preferably having from 1 to 20 carbon atoms, such as methyl, propyl, t-butyl, or trifluoromethyl, tridecyl), an aryl group (,preferably having from 6 to 20 carbon atoms, such as phenyl, 4-t-butylphenyl, 2,4-di-t-amylphenyl, or 4-methoxyphenyl), a heterocyclic group (such as 2-furyl, 2-thienyl, 2-pyrimidinyl, or 2-benzthiazolyl), an alkylamino group (preferably having from 1 to 20 carbon atoms, such as methylamino, diethylamino, t-butylamino), an acylamino group (preferably having from 2 to 20 carbon atoms, such as acetylamino, propylamido, benzamido), an anilino group (such as phenylamino, 2-chloroanilino), an alkoxycarbonyl group (preferably having from 2 to 20 carbon atoms, such as methoxycarbonyl, butoxycarbonyl, 2-ethylhexyloxycarbonyl), an alkylcarbonyl group (preferably having from 2 to 20 carbon atoms, such as acetyl, butylcarbonyl, cyclohexylcarbonyl), an arylcarbonyl group (preferably having from 7 to 20 carbon atoms, such as benzoyl, or 4-t-butylbenzoyl), an alkylthio group (preferably having from 1 to 20 carbon atoms, such as methylthio, octylthio, 2-phenoxyethylthio), an arylthio group (preferably having from 6 to 20 carbon atoms, such as phenylthio, 2-butoxy-5-t-octylphenylthio), a carbamoyl group (preferably having from 1 to 20 carbon atoms, such as N-ethylcarbamoyl, N,N-dibutylcarbamoyl, N-methyl-N-butylcarbamoyl), a sulfamoyl group (preferably $NH_2SO_2$ and a group having from 1 to 20 carbon atoms, such as N-ethylsulfamoyl, N,N-diethylsulfamoyl, N,N-dipropylsulfamoyl), or an alkyl sulfonamido group (preferably having from 6 to 20 carbon atoms, such as benzenesulfonamido, p-toluenesulfonamido).

Preferred examples of divalent linking groups L, to use in combination with magenta dye forming coupler moieties, include —O—, —NH—, —S—, substituted and unsubstituted phenoxy, substituted and unsubstituted aryl thiol, —NH-$SO_2$—, substituted and unsubstituted pyrazole, substituted and unsubstituted imidazole, substituted and unsubstituted 1,2,4-triazole, and —N=N—.

Preferred examples of magenta dye forming coupler monomers comprising preferred COUP and L moieties include the following:

m-i

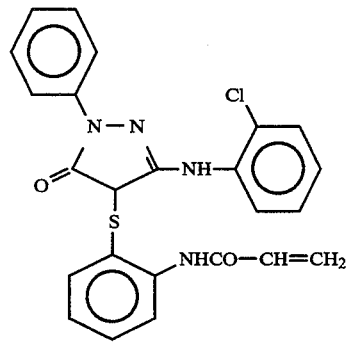

m-ii

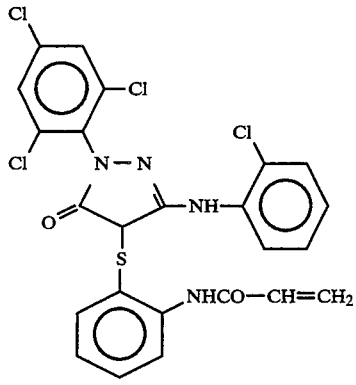

-continued
m-iii
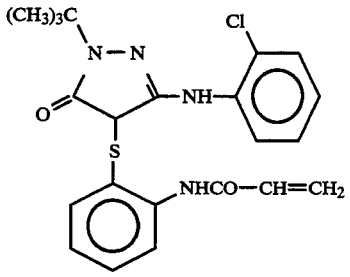
m-iv
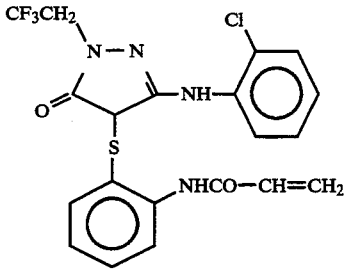
m-v
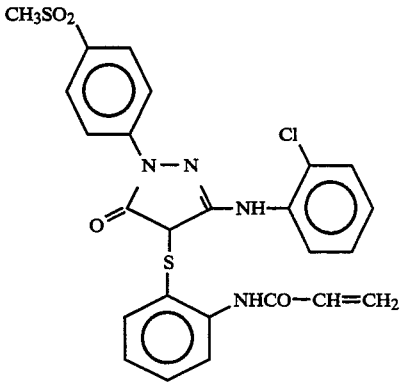
m-vi
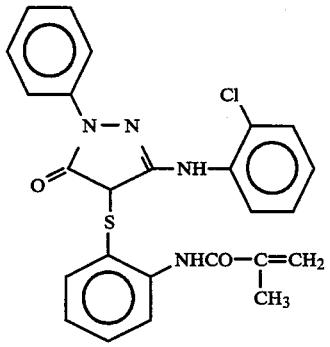
m-vii
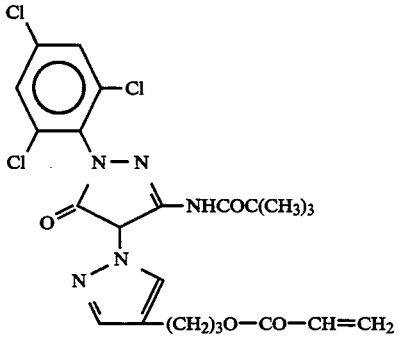
-continued
m-viii
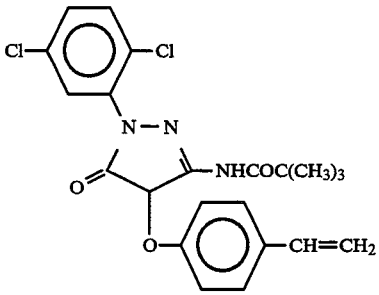
m-ix
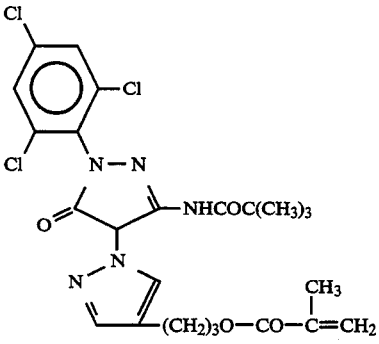
m-x
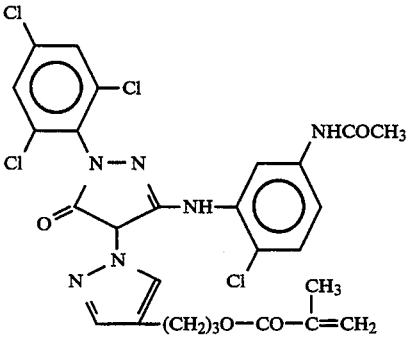
m-xi
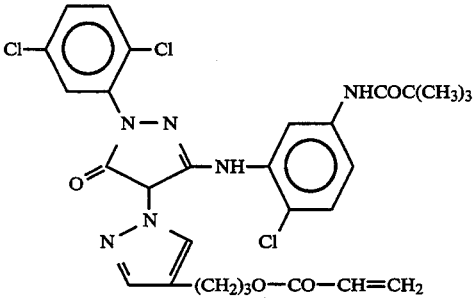
m-xii
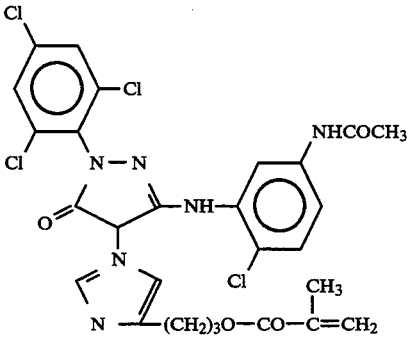

-continued
m-xiii
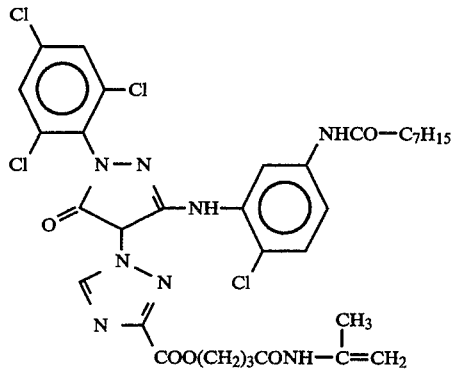
m-xiv
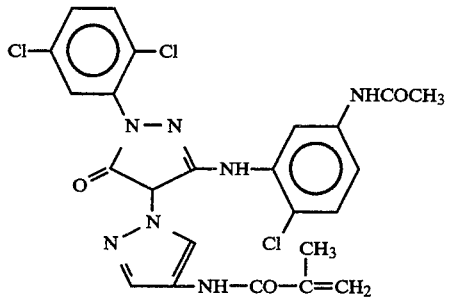
m-xv
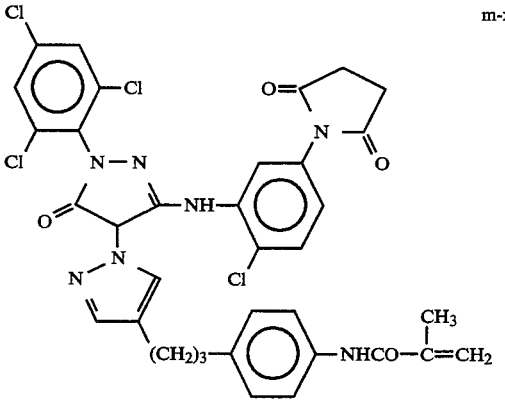
m-xvi
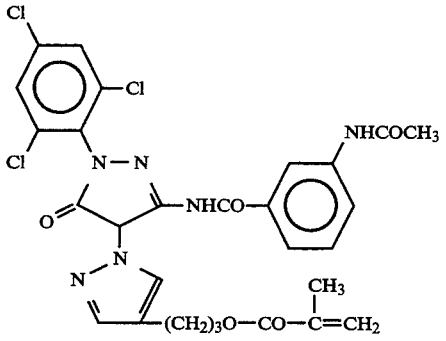
-continued
m-xvii
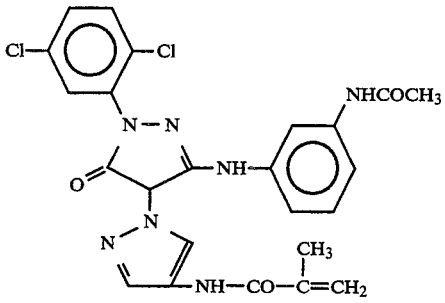
m-xviii
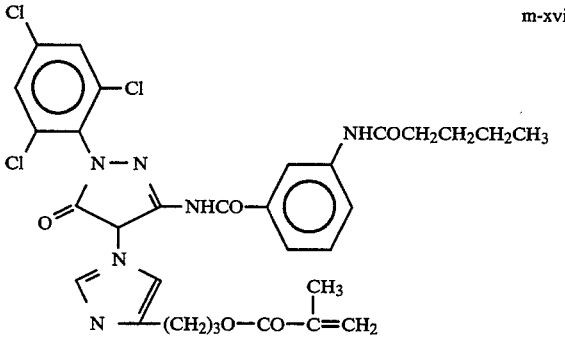
m-xix
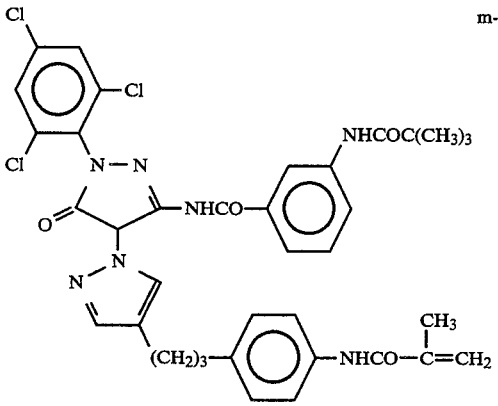
m-xx
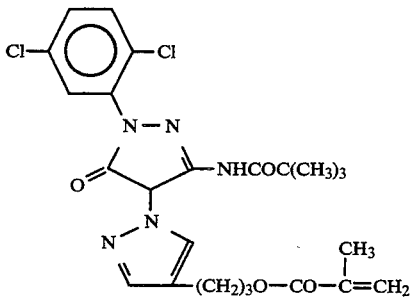
m-xxi
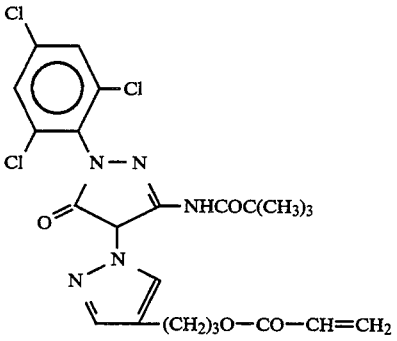

-continued
m-xxii
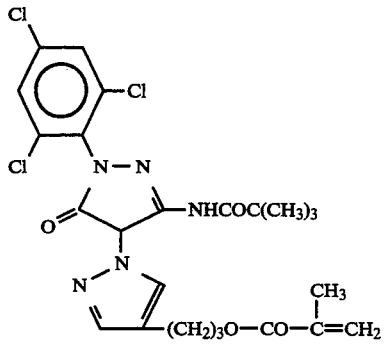
m-xxiii
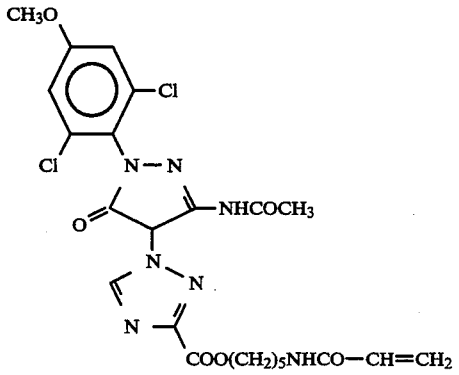
m-xxiv
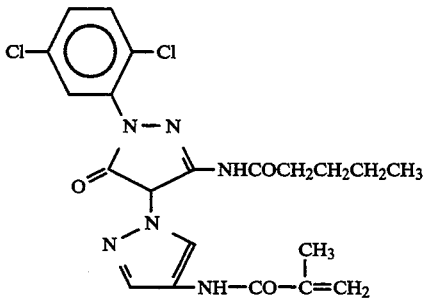
m-xxv
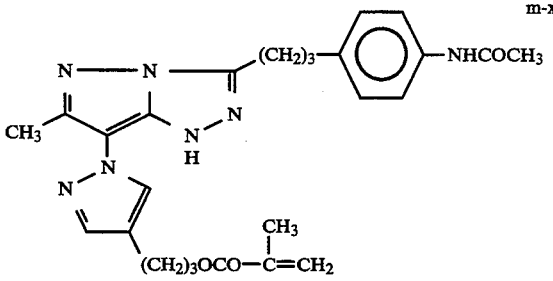
m-xxvi
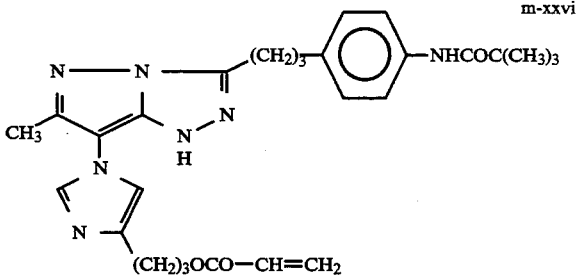
-continued
m-xxvii
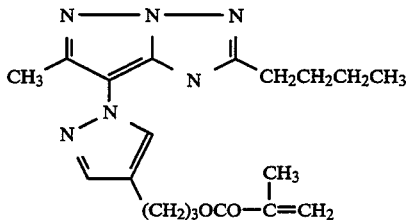
m-xxviii
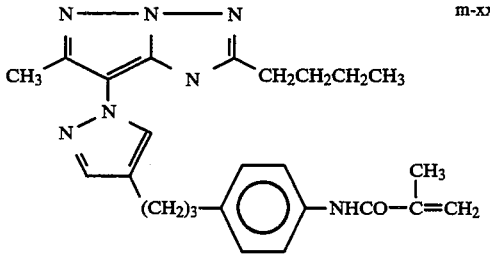
m-xxix
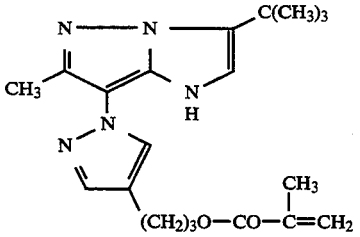
m-xxx
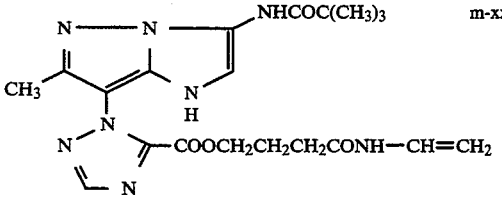
m-xxxi
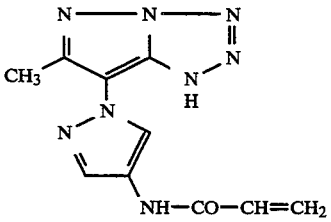
m-xxxii
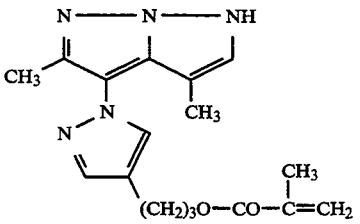
m-xxxiii
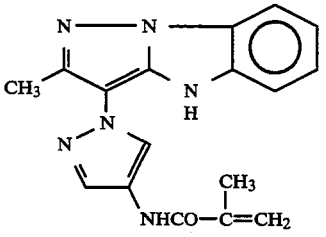

COUP may represent a coupler moiety, capable of forming a yellow dye by coupling with an aromatic primary amine developing agent. Couplers which form yellow dyes upon reaction with oxidized color developing agent are described in such representative U.S. Pat. Nos. as 2,298,443, 2,875,057, 2,407,210, 3,265,506, 3,384,657, 3,408,194, 3,415,652, 3,447,928, 3,542,840, 4,046,575, 3,894,875, 4,095,983, 4,182,630, 4,203,768, 4,221,860, 4,326,024, 4,401,752, 4,443,536, 4,529,691, 4,587,205, 4,587,207 and 4,617,256, and in European Patent Applications 0 259 864 A2, 0 283 938 A1, and 0 316 955 A3, the disclosures of which are incorporated by reference. Preferred yellow dye image forming couplers are acylacetamides, such as benzoylacetanilides and pivalylacetanilides, which can form heat transferable dyes upon reaction with oxidized color developing agent. Preferred coupler moieties COUP which form yellow dyes upon reaction with oxidized color developing agents are of the acylacetanilide type (formula Y-I) and benzoylacetanilide type (formulae Y-II and Y-III); the asterisk mark indicates the position of the bond to the divalent linking group L in formula (I)

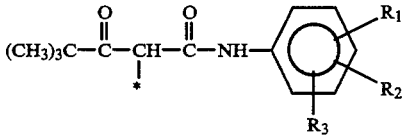

Y-I

-continued

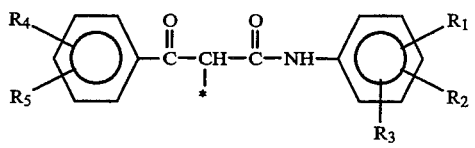

Y-II

In formulae Y-I, Y-II, and Y-III above:

$R_1$, $R_2$, $R_3$, $R_4$, and $R_5$ each independently represents a hydrogen atom or a substituent which is conventional and well known in a yellow coupler group, for example, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkylsubstituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group, or thiocyano group.

Preferred examples of divalent linking groups L, to use in combination with yellow dye forming coupler moieties, include —O—, —NH—, —S—, substituted and unsubstituted phenoxy, substituted and unsubstituted hydantoin, substituted and unsubstituted aryl thiol, —NH—$SO_2$—, substituted and unsubstituted pyrazole, substituted and unsubstituted imidazole, substituted and unsubstituted 1,2,4-triazole, substituted and unsubstituted urazole, substituted and unsubstituted 1,2,3,4-tetrazole-5-one, substituted and unsubstituted benztriazole, substituted and unsubstituted benzimidazole, and substituted and unsubstituted phthalimide.

Preferred examples of yellow dye forming coupler monomers comprising preferred COUP and L moieties include the following:

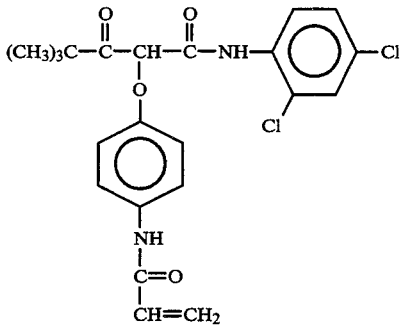

y-i

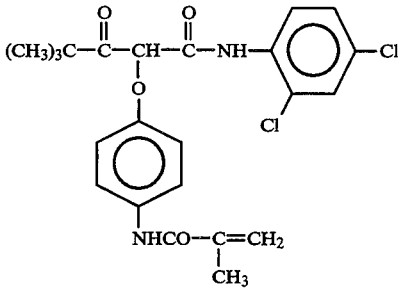

y-ii

-continued
y-iii
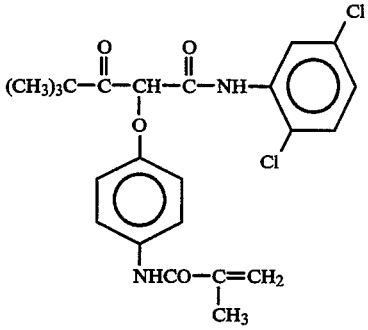
y-iv
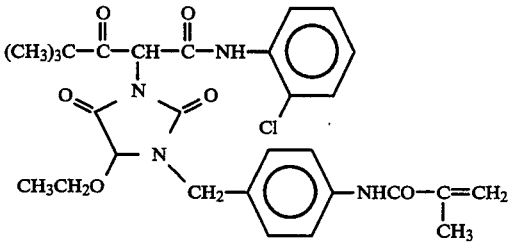
y-v
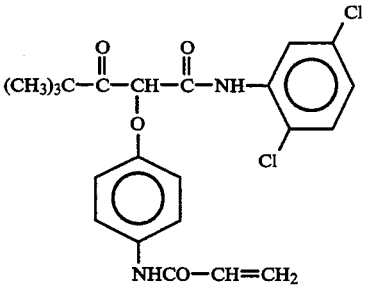
y-vi
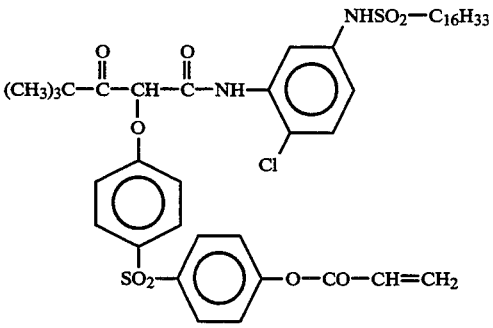
y-vii
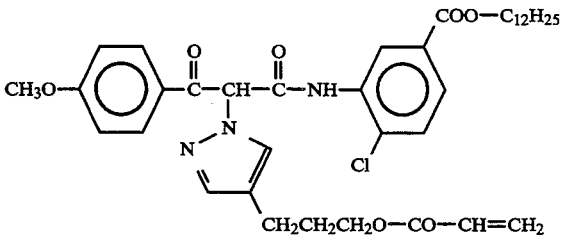

-continued
y-viii
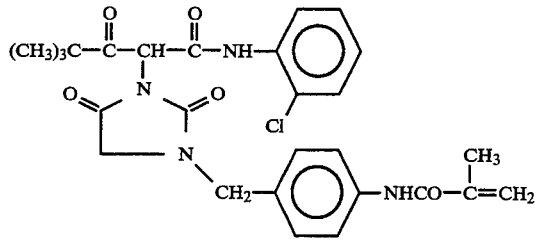
y-ix
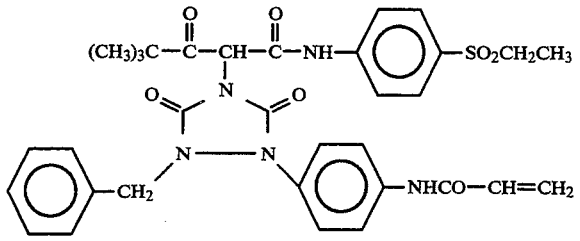
y-x
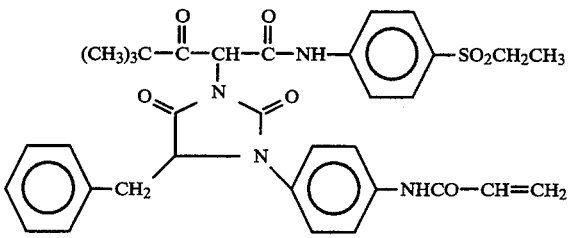
y-xi
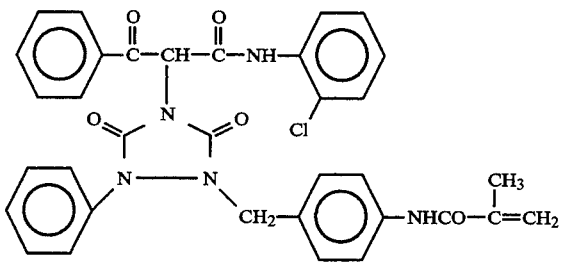
y-xii
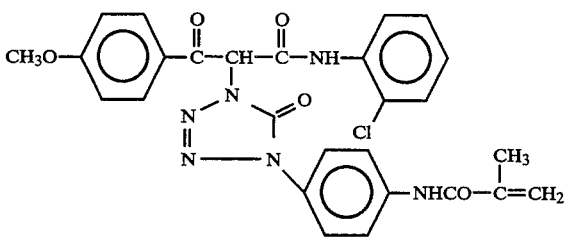
y-xiii
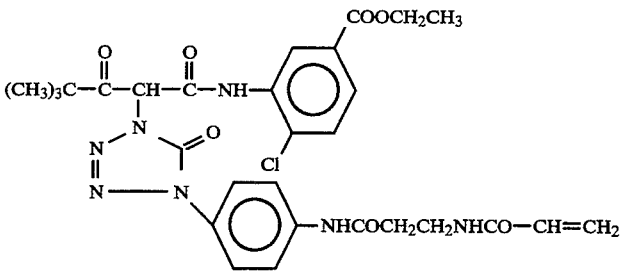

-continued
y-xiv
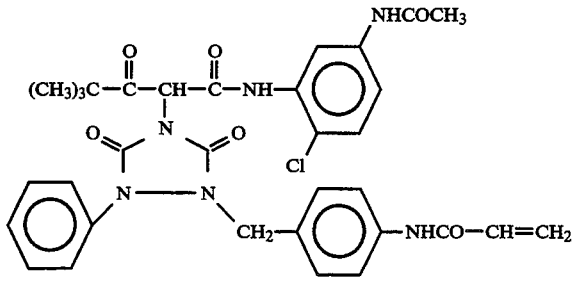
y-xv
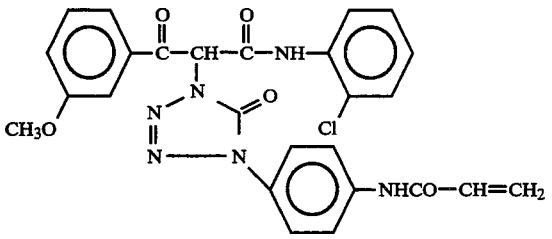
y-xvi
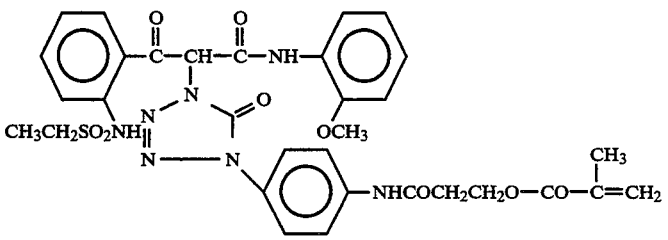
y-xvii
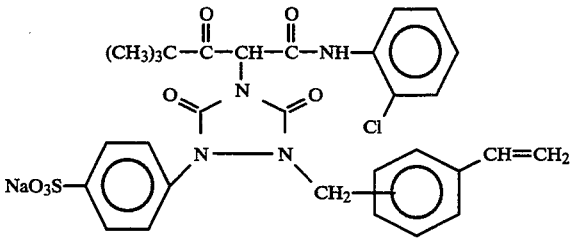
y-xviii
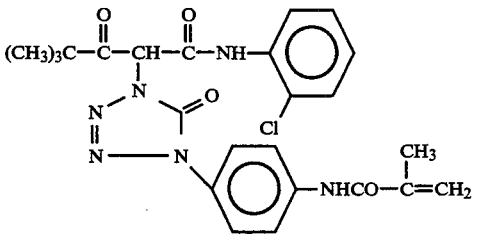
y-xix
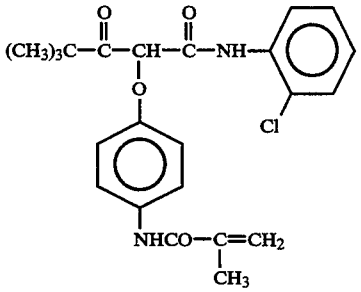

-continued
y-xx
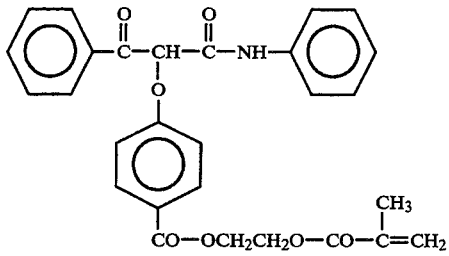
y-xxi
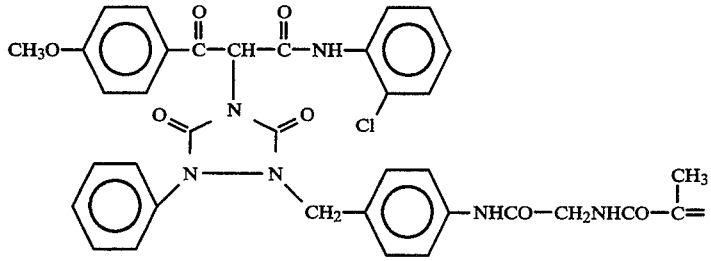
y-xxii
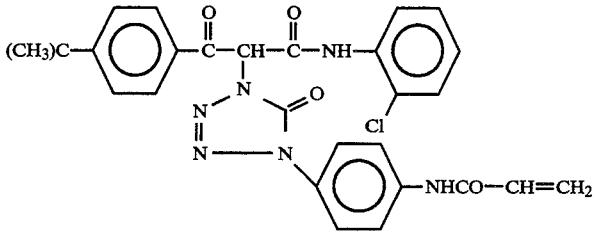
y-xxiii
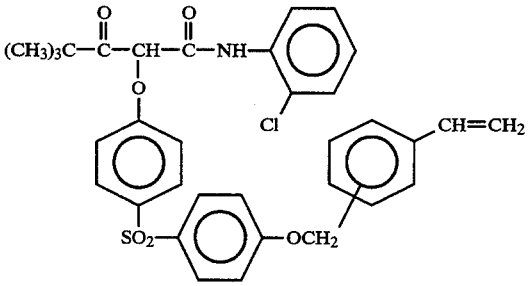
y-xxiv
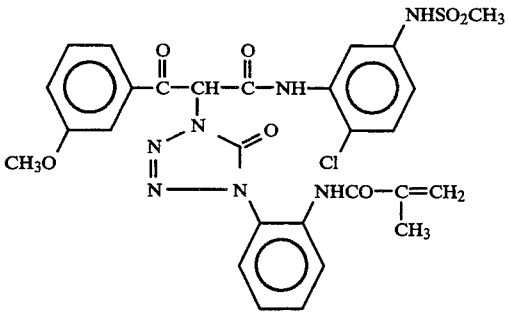

-continued
y-xxv
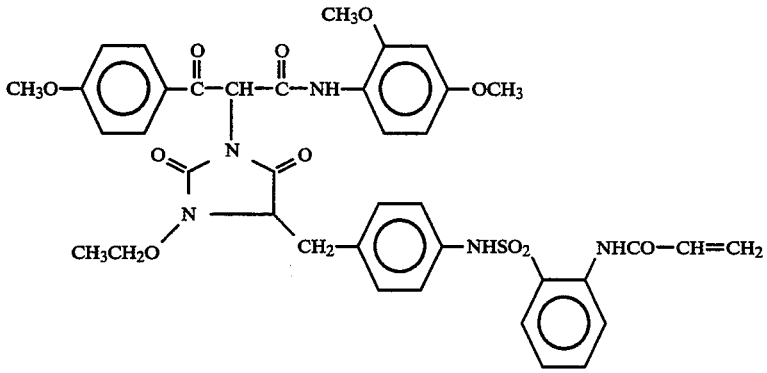
y- xxvi
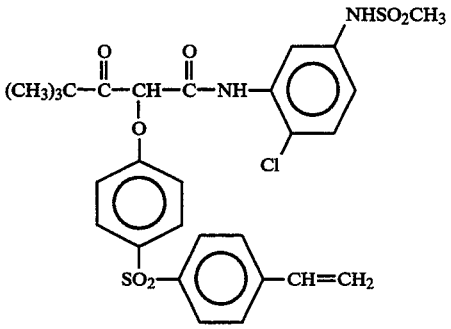
y-xxvii
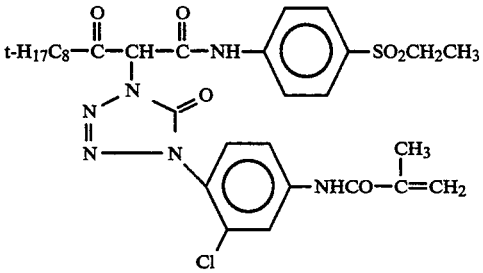
y-xxviii
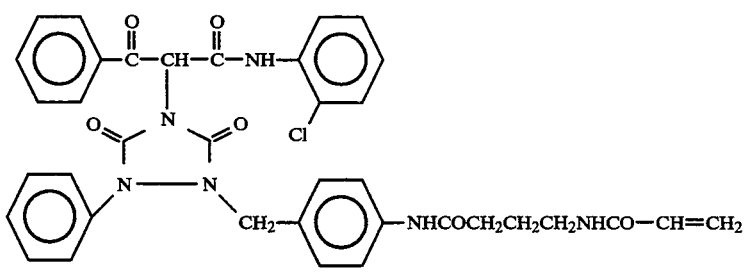
y-xxix
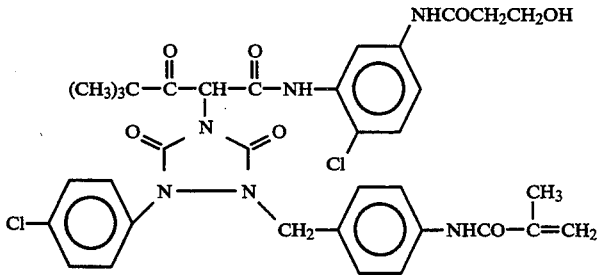

-continued
y- xxx
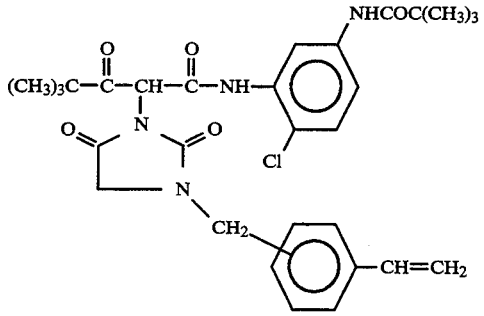
y-xxxi
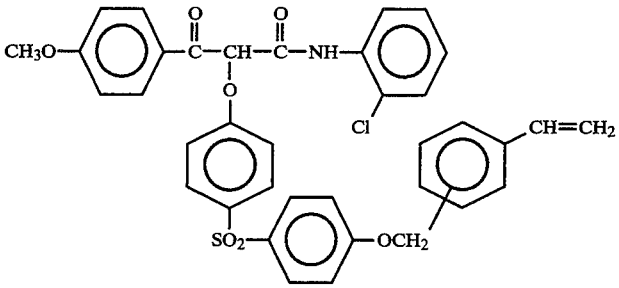
y-xxxii
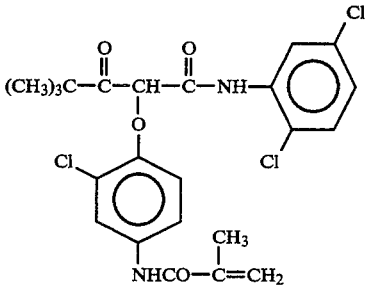
y-xxxiii
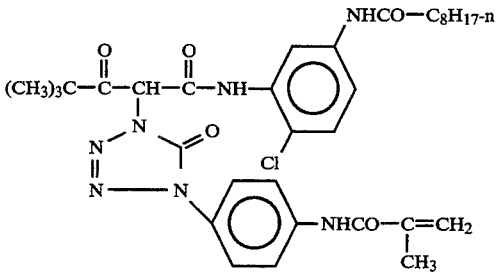
y-xxxiv
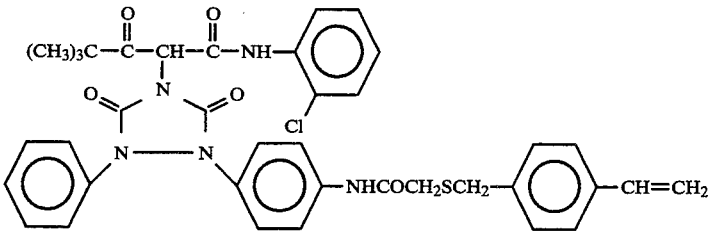
y-xxxv
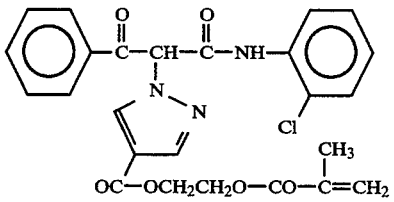

-continued
y-xxxvi
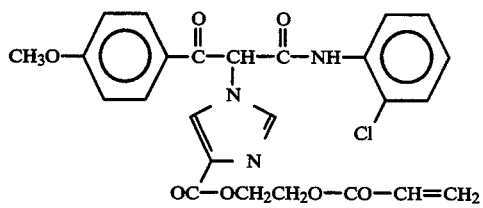
y-xxxvii
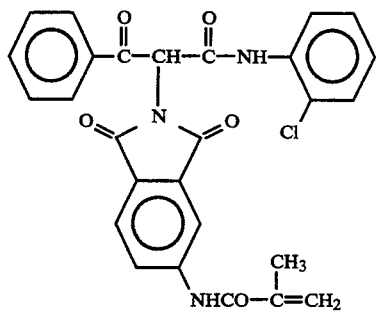
y-xxxviii
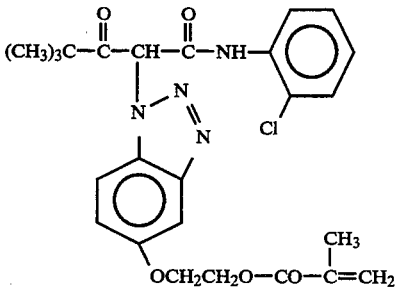
y-xxxix
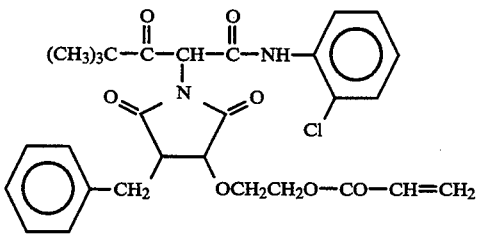
y-xl
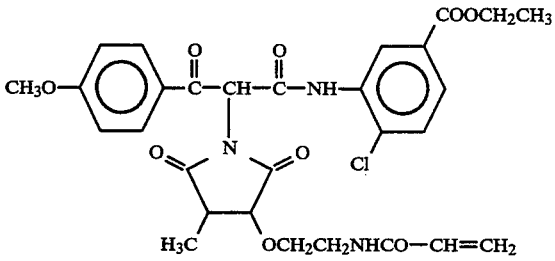
y-xli
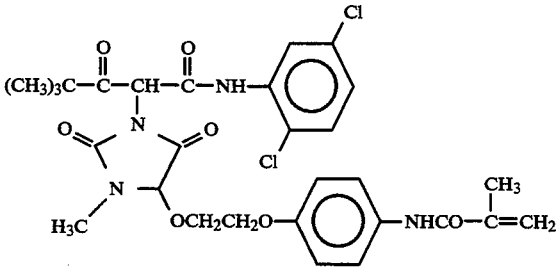

-continued y-xlii

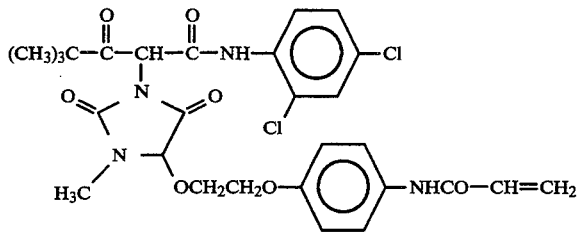

y-xliii

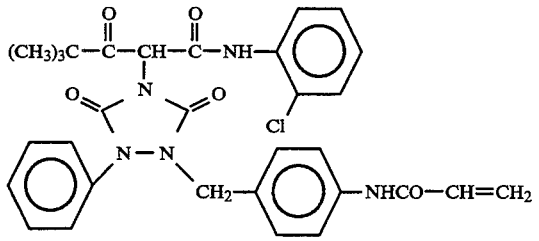

y-xliv

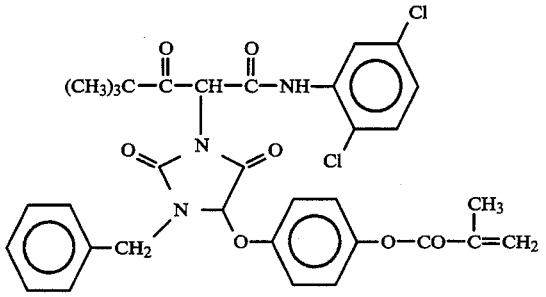

y-xlv

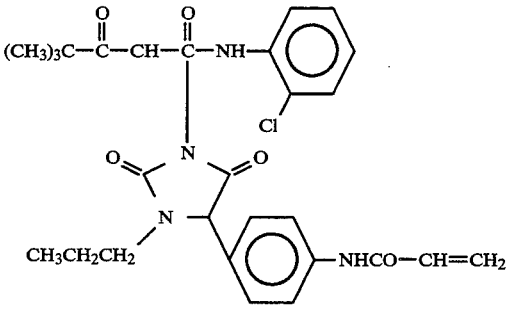

y-xlvi

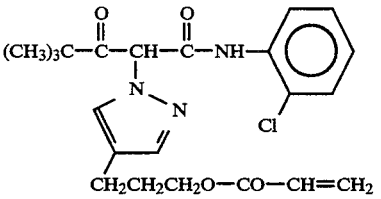

The polymeric couplers of the present invention may include homopolymers of any ethylenic monomeric couplers, copolymers of two or more ethylenic monomeric couplers, and copolymers of at least one ethylenic monomeric coupler and at least one non-color forming ethylenic monomer which does not couple with the oxidation product of a primary amine developing agent. Copolymers of ethylenic monomeric couplers and non-color forming ethylenic monomers are preferred.

Examples of non-color forming ethylenic monomers which do not couple with the oxidation product of a primary amine developing agent include acrylic acid, α-chloroacrylic acid, methacrylic acid, acrylamide, methacrylamide, n-butylacrylamide, t-butylacrylamide, diacetone acrylamide, methyl acrylate, ethyl acrylate, n-propyl acrylate, isopropyl acrylate, n-butyl acrylate, t-butyl acrylate, isobutyl acrylate, hexyl acrylate, 2-ethylhexyl acrylate, n-octyl acrylate, lauryl acrylate, 3-acroyl propanesulfonic acid, acetoacetoxyethyl acrylate, acetoxyethyl acrylate, phenyl acrylate, 2-methoxy acrylate, 2-ethoxy acrylate, 2-(2-methoxyethoxy)ethyl acrylate, methyl methacrylate, ethyl methacrylate, n-propyl methacrylate, isopropyl methacrylate, n-butyl methacrylate, t-butyl methacrylate, isobutyl methacrylate, β-hydroxy methacrylate, cyclohexyl methacrylate, 2-hydroxyethyl methacrylate, tetrahydrofurfuryl methacrylate, epoxyethyl methacrylate, vinyl acetate, vinyl propionate, vinyl butyrate, vinyl laurate, vinylmethoxy acetate, vinyl benzoate, acrylonitrile, methacrylonitrile, styrene, vinyl toluene, divinyl benzene, vinyl acetophenone, sulfostyrene, triethyl styrene, isopropyl styrene, butyl styrene, chloromethyl styrene, methoxy styrene, butoxy styrene acetoxy styrene, chlorostyrene, dichlorostyrene, bromostyrene, 2-methyl styrene, styrene sulfinilic acid, itaconic acid, diethyl itaconate, dibutyl itaconate, citraconic acid, crotonic acid, butyl crotonate, hexyl crotonate, vinylidene chloride, vinyl methyl ether, vinyl ethyl ether, vinyl butyl ether, vinyl hexyl ether, vinyl methoxyethyl ether, vinyl dimethylaminoethyl ether, N-vinyl-2-pyrrolidone, N-vinylpyridine, 2-vinylpyridine, 4-vinylpyridine, diethyl maleate, dimethyl maleate, dibutyl maleate, diethyl fumarate, dimethyl fumarate, dibutyl fumarate, acrylamide, methyl acrylamide, ethyl acrylamide, isopropyl acrylamide, n-butyl acrylamide, hydroxymethyl acrylamide, diacetone acrylamide, acryloyl morpholine, acrylamido-2-methylpropanesulfonate, methyl methacrylamide, ethyl methacrylamide, n-butyl methacrylamide, t-butyl methacrylamide, 2-methoxy methacrylamide, dimethyl, diethyl methacrylamide, allyl acetate, vinyl methyl ketone, vinyl methacrylamide sulfonic acid, other acrylic acids, other $\alpha$-alkyl acrylates, other esters derived from acrylic acids, other amides derived from acrylic acids, other vinyl esters, other aromatic vinyl compounds, other vinyl alkyl ethers, other esters of itaconic acid, other esters of fumeric acid, other esters of maleic acid, alkali and ammonium salts of sulfonic acids, alkali and ammonium salts of sulfinilic acids, and other vinyl ketones.

Of these non-color forming ethylenic monomers, acroylalkylsulfonates, methacyloyloxyalkylsulfonates, acrylamidoalkylsulfates, methacrylamidoalkylsulfonates, alkali and ammonium salts of these sulfonates, esters of acrylic acid, esters of methacrylic acid, and esters of maleic acid are particularly preferred. Two or more such non-color forming ethylenic monomers may be used together and in any desired combination so as to obtain desired physical and chemical properties such as solubility, gelatin compatibility, flexibility, and thermal stability in the resulting polymer. For example, the combinations of methyl acrylate and butyl acrylate, butyl acrylate and styrene, butyl methacrylate and methacrylic acid, methyl acrylate and diacetone acrylamide, potassium styrenesulfinate and sodium acrylamide-2-methylpropanesulfonate, acetoacetoxyethyl methacrylate and sodium 3-acryloylpropanesulfonate, potassium styrenesulfinate and sodium acryloyloxypropane sulfonate can be used.

It will be understood by one skilled in the art that the above listed coupler moieties, non-color forming monomeric moieties, linking groups, and polymeric backbone groups are representative and not exclusive. Further examples of such groups usable in the present invention are disclosed in U. Pat. Nos. 4,584,267 and 4,948,698, the disclosures of which are incorporated by reference above.

Polymeric couplers of the present invention may be prepared by any radical polymerization method well known in the art. Polymeric couplers of the present invention may be prepared by emulsion polymerization as is described in *Emulsion Polymerization* (F. A. Bovey, Interscience Publishers, New York, 1955), in U.S. application Ser. Nos. 387,128 and 377,271, in European Patent Application Nos. 0 259 864 A2 and 0 316 955 A3, and in U.S. Pat. Nos. 4,367,282, 4,388,404, 4,435,503, 4,436,808, 4,444,870, and 4,522,916, the disclosures of which are incorporated herein by reference.

Polymeric couplers of the present invention may be prepared by solution polymerization methods as described in U. Pat. Nos. 4,455,368, 4,474,870, 4,436,808, 4,455,366, 4,522,916, 4,540,654, 4,576,910, 4,668,613, European Patent No. 0 259 864 B1, European Patent Application No. 0 283 938 A1, and in U.S. application Ser. No. 7/879,044, filed May 6, 1992 by Chen et al., the disclosures of which are incorporated herein by reference.

Polymeric couplers of the present invention may be prepared by radical polymerization methods using chain transfer agents to produce a class of polymeric couplers known as telomeric couplers. Such methods are described in U.S. Pat. No. 4,874,689 and in European Patent Application No. 0 3 16 955 A3, the disclosures of which are incorporated herein by reference.

Polymeric couplers of the present invention may be prepared by radical polymerization methods using microemulsion polymerization techniques as described in U.S. application Ser. No. 7/796,107, filed Nov. 21, 1991 by Texter et al., now U.S. Pat. No. 5,234,807 the disclosure of which is incorporated herein in its entirety.

It is preferred that the molecular weight of the polymeric couplers of the present invention be in the range of 5,000 to 10,000,000. It is more preferred that the molecular weight of the polymeric couplers of the present invention be in the range of 10,000 to 2,000,000. It is undesirable for the molecular weight of the polymeric couplers of the present invention to be too low, because unwanted thermal diffusion transfer of said couplers might then occur. It is preferred that the molecular weight of the polymeric couplers of the present invention not be so large as to make their coating difficult or so large as to make their dispersal in a form suitable for coating in a photographic colloid difficult.

Exposed photographic elements containing coupler compounds of formula (I) according to the invention are developed with a color developer solution in order to form a heat transferable dye image. In principle, any combination of developer agent and polymeric coupler compound which forms a heat transferable dye upon development may be used. Selection of substituents for the polymeric coupler compounds of the invention as well as the developer agent will affect whether a heat transferable dye is formed upon development. Whether a particular coupler compound and developer agent combination generates a heat transferable dye suitable for use in the present invention will be readily ascertainable to one skilled in the art through routine experimentation.

Preferred color developing agents useful in the invention are p-phenylenediamines. Especially preferred are:

4-amino-N,N-diethylaniline hydrochloride;

4-amino-3-methyl-N,N-diethylaniline hydrochloride;

4-amino-3-methyl-N-ethyl-N-(p-methanesulfonamidoethyl)aniline sulfate hydrate;

4-amino-3-methyl-N-ethyl-N-(p-hydroxyethyl) aniline sulfate;

4-amino-3-(p-methanesulfonamido)ethyl-N,N-diethylaniline hydrochloride;

4-amino-3 -methyl-N-ethyl-N-(p-methanesulfonamidoethyl)aniline sesquisulfate monohydrate; and 4-amino-3-methyl-N-ethyl-N-(2-methoxyethyl)aniline di-p-toluenesulfonic acid.

Photographic elements in which the photographic couplers of formula (I) are incorporated can be simple elements comprising a support and a single silver halide emulsion layer, or they can be multilayer, multicolor elements. The silver halide emulsion layer can contain, or have associated therewith, other photographic addenda conventionally contained in such layers.

A typical multilayer, multicolor photographic element according to this invention comprises a support having thereon a red sensitive silver halide emulsion layer having associated therewith a cyan dye image forming coupler compound, a green-sensitive silver halide emulsion layer having associated therewith a magenta dye image forming coupler compound and a blue sensitive silver halide emulsion layer having associated therewith a yellow dye image forming coupler compound. Each silver halide emulsion layer can be composed of one or more layers and the layers can be arranged in different locations with respect to one another. Typical arrangements are described in *Research Disclosure,* Issue Number 308, pp. 993–1015, published December, 1989 (hereafter referred to as "Research Disclosure"), the disclosure of which is incorporated by reference.

The light sensitive silver halide emulsions can include coarse, regular or fine grain silver halide crystals of any shape or mixtures thereof and can be comprised of such silver halides as silver chloride, silver bromide, silver bromoiodide, silver chlorobromide, silver chloroiodide, silver chlorobromoiodide and mixtures thereof. The emulsions can be negative working or direct positive emulsions. They can form latent images predominantly on the surface of the silver halide grains or predominantly on the interior of the silver halide grains. They can be chemically or spectrally sensitized. The emulsions typically will be gelatin emulsions although other hydrophilic colloids as disclosed in Research Disclosure can be used in accordance with usual practice.

The support can be of any suitable material used with photographic elements. Typically, a flexible support is employed, such as a polymeric film or paper support. Such supports include cellulose nitrate, cellulose acetate, polyvinyl acetal, poly(ethylene terephthalate), polycarbonate, white polyester (polyester with white pigment incorporated therein) and other resinous materials as well as glass, paper or metal. Paper supports can be acetylated or coated with baryta and/or an alpha-olefin polymer, particularly a polymer of an alpha-olefin containing 2 to 10 carbon atoms such as polyethylene, polypropylene or ethylene butene copolymers. The support may be any desired thickness, depending upon the desired end use of the element. In general, polymeric supports are usually from about 3 μm to about 200 μm and paper supports are generally from about 50 μm to about 1000 μm.

The dye receiving layer to which the formed dye image is transferred according to the process of the invention may be present as a coated or laminated layer between the support and silver halide emulsion layer(s) of the photographic element, or the photographic element support itself may function as the dye receiving layer. Alternatively, the dye receiving layer may be in a separate dye receiving element which is brought into contact with the photographic element before or during the dye transfer step. If present in a separate receiving element, the dye receiving layer may be coated or laminated to a support such as those described for the photographic element support above, or may be self-supporting. In a preferred embodiment of the invention, the dye-receiving layer is present between the support and silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-coacrylonitrile)s, poly(caprolactone)s and mixtures thereof. The dye receiving layer may be present in any amount which is effective for the intended purpose. In general, good results have been obtained at a concentration of from about 1 to about 10 $g/m^2$ when coated on a support. In a preferred embodiment of the invention, the dye receiving layer comprises a polycarbonate. The term polycarbonate as used herein means a polyester of carbonic acid and a glycol or a dihydric phenol. Examples of such glycols or dihydric phenols are paraxylene glycol, 2,2-bis(4-oxyphenyl) propane, bis(4-oxyphenyl)methane, 1,1 -bis(4-oxyphenyl) ethane, 1,1-bis(oxyphenyl)butane, 1,1-bis(oxyphenyl) cyclohexane, 2,2-bis(oxyphenyl)butane, etc. In a particularly preferred embodiment, a bisphenol-A polycarbonate having a number average molecular weight of at least about 25,000 is used. Examples of preferred polycarbonates include General Electric LEXAN® Polycarbonate Resin and Bayer AG MACROLON 5700®. Further, a thermal dye transfer overcoat polymer as described in U. Pat. No. 4,775,657 may also be used. Heating times of from about 10 seconds to 30 minutes at temperatures of from about 50° to 200° C. (more preferably 75° to 160° C., and most preferably 80° to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of about 0.1 to 50 cm/sec are preferred to effect transfer at nip pressures of from about 500 Pa to about 1,000 kPa and nip temperatures of from about 75° to 190° C.

Thermal solvents may be added to any layer(s) of the photographic element (and separate receiving element) in order to facilitate transfer of the formed dye image from the emulsion layer to the dye receiving layer. Preferred thermal solvents are alkyl esters of meta- and para-hydroxy benzoic acid, which have been found to be particularly effective in facilitating dye transfer through dry gelatin as described in copending, commonly assigned U.S. application Ser. No. 7/804,868, filed Dec. 6, 1991, of Bailey et al., the disclosure of which is incorporated by reference. Said thermal solvents are preferably incorporated in a given layer at a level of 1–300 % by weight of the hydrophilic colloid incorporated in said layer.

After the dye image is transferred, the dye receiving layer may be separated from the emulsion layers of the photographic element by stripping one from the other.

Automated stripping techniques applicable to the present invention are disclosed in copending U.S. application Ser. No. 7/805,717, filed Dec. 6, 1991, of Texter et al., now U.S. Pat. No. 5,164,280 the disclosure of which is incorporated by reference.

Further details regarding silver halide emulsions and elements, and addenda incorporated therein can be found in Research Disclosure, referred to above.

The terms "in association" or "associated with" are intended to mean that materials can be in either the same or different layers, so long as the materials are accessible to one another.

Photographic elements as described above are exposed in the process of the invention. Exposure is generally to actinic radiation, typically in the visible region of the spectrum, to form a latent image as described in Research Disclosure Section XVIII. The exposure step may also include exposure to radiation outside the visible region. The following examples are provided to help further illustrate the invention.

EXAMPLES 1-2

Preparation of Yellow Monomer (Y1)

The structure of Y1 is identical to that of y-i illustrated earlier in the specification. In a 5L 3-neck round-bottomed flask, equipped with an addition funnel, mechanical stirrer, and thermometer, about 600 g (2.1 mol) of starting material i was dissolved in 3 L of toluene while stirring under nitrogen; a yellow solution resulted. About 190 mL (2.3 mol) of sulfuryl chloride was added dropwise over a 45 minute period while maintaining the temperature below 25° C. After about 3 hours, thin layer chromatography (TLC) indicated a trace of starting material was still present; an additional 10 mL of sulfuryl chloride was then added to drive the reaction to completion. The toluene was then removed by rotary evaporation and the brown oil obtained was mixed with about 500 mL of hexanes, and a white crystalline product, intermediate ii, was obtained.

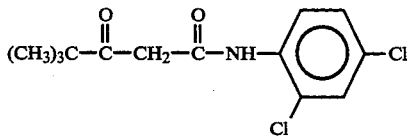

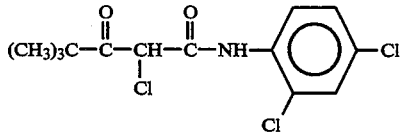

In a 2-L 3-neck round-bottomed flask equipped with a mechanical stirrer and thermometer, about 95 g (0.68 mol) of p-nitrophenol and about 200 g (0.62 mol) of intermediate ii were dissolved in about 800 mL of dimethylformamide (DMF) to produce an orange-brown solution. This solution was heated to 40° C., and tetramethylquanidine (TMG; about 143 g, 1.2 mol) was then added dropwise over a period of 30 minutes. During this period the reaction mixture darkened, turned red, and the temperature rose to about 60° C. Thereafter, the reaction mixture was maintained at about 50° C. for about 3.5 hours, during which time the reaction went to completion. After cooling the mixture to room temperature, about 1 L of ethyl acetate was added and then the mixture was quenched by adding to a 1 L volume of ice/HCl (50:50 by weight). The organic layer was washed three times with about 100 mL of 10% aqueous HCl, and the yellow aqueous layer was washed three times with about 100 mL of ethyl acetate. The organic fraction was concentrated to give a yellow solid; this fraction was triturated with about 250 mL of methanol to give a white crystalline solid. This solid was washed with methanol and yielded about 208 g of intermediate iii. The filtrate was concentrated and washed twice with 50 mL of water, and yielded an additional 15.9 g of iii. The nitro group in iii was reduced to the primary amine to yield intermediate iv by catalytic (Raney cobalt; RaCo) reduction. About 614 g (1.44 mol) of iii was dissolved in about 7L tetrahydrofuran (THF) and combined with about 150 g of prereduced RaCo; hydrogen pressure was maintained at about 450 psi for 3 hours at about 28° C. to effect complete reaction.

About 15.2 g (38.5 mmol) of iv in about 50 mL of THF was stirred in a 250 mL 3-neck round-bottomed flask equipped with a thermometer and addition funnel.

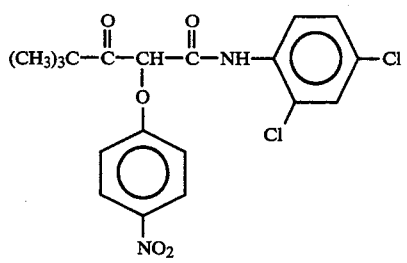

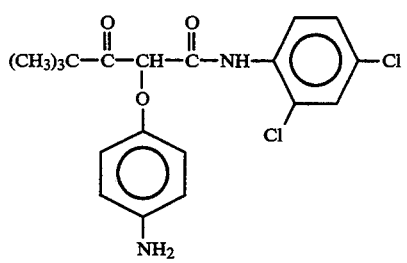

The light brown solution was cooled to about 5° C. About 3.5 mL (42.2 mmol) of acryloyl chloride was added dropwise over a period of about 15 minutes while keeping the reaction temperature below 15° C. The brown solution was poured slowly into a rapidly stirring mixture of 20 mL HCl (concentrated), 200 mL ice, and 20 mL water. A brown precipitate formed immediately. This precipitate was filtered, washed with water, and sucked dry overnight. The product was then placed in a 40° C. vacuum oven and dried to yield 16.5 g of Y1.

Preparation of Polymeric Coupler Y2

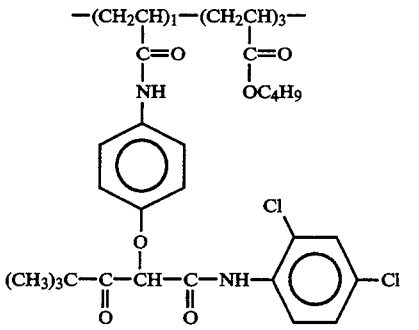

(Y2)

Deionized water (about 100 g), about 2.08 g of 20% (w/w) sodium N-methyl-N-oleoyltaurate (Igepon T-77), and about 10 g of acetone were mixed in a 250 mL 4-necked roundbottom flask equipped with a mechanical stirrer, nitrogen inlet, and condenser. The flask was immersed in a constant temperature bath at 80° C. and heated for 30 min with nitrogen purging. A monomer solution comprising about 4.493 g of monomer Y1 (0.01 mol), about 3.846 g of butyl acrylate (0.03 mol), and about 50 mL of N,N-dimethylformamide was prepared. About 2 g of 5% (w/w) ammonium persulfate was added to the reactor and stirred for 3 min. The monomer solution was then pumped into the reactor over 2.5 h. The polymerization was continued for 8 h. The latex suspension was then cooled, filtered, and dialyzed against distilled water overnight. The latex was then concentrated to about 7.8% (w/w) solids with an Amicon ultrafiltration unit. The z-average particle size measured by a Malvern Autosizer IIC was about 95 nm. The elemental analysis results were: C (60.76%); H (6.93%); N (3.47%); Cl (4.97%).

Preparation of Comparison Coupler (Y3) Dispersion

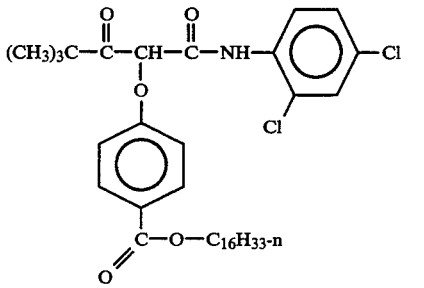

(Y3)

About 8 g of Y3 were dissolved in about 24 g of ethyl acetate at about 60° C. An aqueous gelatin solution comprising about 3.2 g of 10% (w/w) Alkanol-XC (Du Pont). about 19.2 g 12.5% (w/w) aqueous gelatin, and about 19.2 g water was prepared. These aqueous and ethyl acetate solutions were then combined with stirring and passed through a colloid mill five times to obtain a fine particle dispersion of Y3. The resulting dispersion was chill set, noodled, and washed for about 4 h to remove the ethyl acetate. This dispersion was then remelted, chill set, and stored until use.

Preparation of Thermal Solvent Dispersion

An aqueous solution was prepared at about 50° C. by combining about 3.75 g of 10% (w/w) aqueous Alkanol XC (Du Pont), about 30 g of 12.5% (w/w) gelatin, and about 78.75 g water. About 12.5 g of p-hydroxy-2-ethylhexyl benzoate (Pfaultz and Bauer) was added to this solution with stirring, and this coarse emulsion was then passed through a colloid mill five times to produce a fine particle sized dispersion. This dispersion was then chill set and stored in the cold until used.

Coating Support and Receiver

A reflection base paper material, resin coated with high density polyethylene, was coated with a mixture of polycarbonate, polycaprolactone, and 1,4-didecyloxy-2,5-dimethoxy benzene at a 0.77:0.115:0.115 weight ratio respectively, at a total coverage of 3.28 g/m$^2$.

Preparation of Test Coatings

The test coating structure comprised two layers coated on the receiver support described above. The receiver support was subjected to corona discharge bombardment within about 24 h prior to coating the test elements. The first layer contained gelatin at a coverage of about 1.07 g/m$^2$ , thermal solvent (p-hydroxy-2-ethylhexyl benzoate) at a coverage of about 1.07 g/m$^2$, and blue sensitized silver chloride at a coverage of about 540 mg/m$^2$ as silver. In the control coating 1, the dispersion of Y3 was coated to yield a Y3 coverage of about 1.07 g/m$^2$ . The coating 2 of polymeric coupler Y2 contained a molar equivalent of coupling sites and a corresponding coverage of about 1.38 g/m$^2$ . This first layer was overcoated with a second layer. The second layer contained gelatin at a coverage of about 1.07 g/m$^2$. Hardener, 1,1'-[methylene bis(sulfonyl)]bisethene (MBSE), was coated at a coverage of about 32.1 mg/m$^2$ to crosslink the gelatin.

Evaluation

These test coatings were exposed and processed for 45" at 95° F. in a developer solution comprising the following:

| | |
|---|---|
| Triethanolamine | 12.41 g |
| Phorwite REU (Mobay) | 2.3 g |
| Lithium polystyrene sulfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium chloride | 1.60 g |
| Potassium bromide | 7.0 mg |
| Water to make one liter | |
| pH = 10.04 @ 27° C. | |

These coatings were then dipped in a stop bath (10% (w/w) acetic acid; 60"), rinsed (60" in pH 7 phthalate buffer (VWR); 5 min in water rinse), and dried. The test coatings were then passed through pinch rollers heated to 110° C. under a nip pressure of 20 psi at a rate of 0.25 ips (inches per second). The test coatings were passed through with the emulsion/dye forming and gelatin overcoat layers in contact with the gelatin coated side of a stripping adhesion sheet, as described in U.S. application Ser. No. 7/805,717, now U.S. Pat. No. 5,164,280. This adhesion sheet was subsequently removed by shear from the test element, thereby removing the emulsion/-dye forming and gelatin overcoat layers from the receiver/base support. The resulting transferred dye scale was read by reflection densitometry and/or by reflectance spectroscopy. The receiver and donor (spent dye forming layer) elements were examined imagewise by extracting residual coupler and dye, as determined by HPLC (high performance liquid chromatography).

These coatings were processed as described above, whereby the test coatings were passed through the aforesaid pinch rollers once, and the resulting reflection densitometry (status A filters) is illustrated in FIG. 1. This densitometry shows that the coating of the present invention, Example 2, comprising polymeric coupler Y2, is considerably more active (curve 2) than the coating of the comparison Example 1 (curve 1), comprising coupler Y3. A benefit that can be derived from using polymeric couplers of enhanced reactivity, is that the same amount of dye density can be obtained, as obtained with a conventional coupler dispersion of lower activity, with less coated silver halide and/or with less coated coupler (on an equivalent basis).

Figure 2:
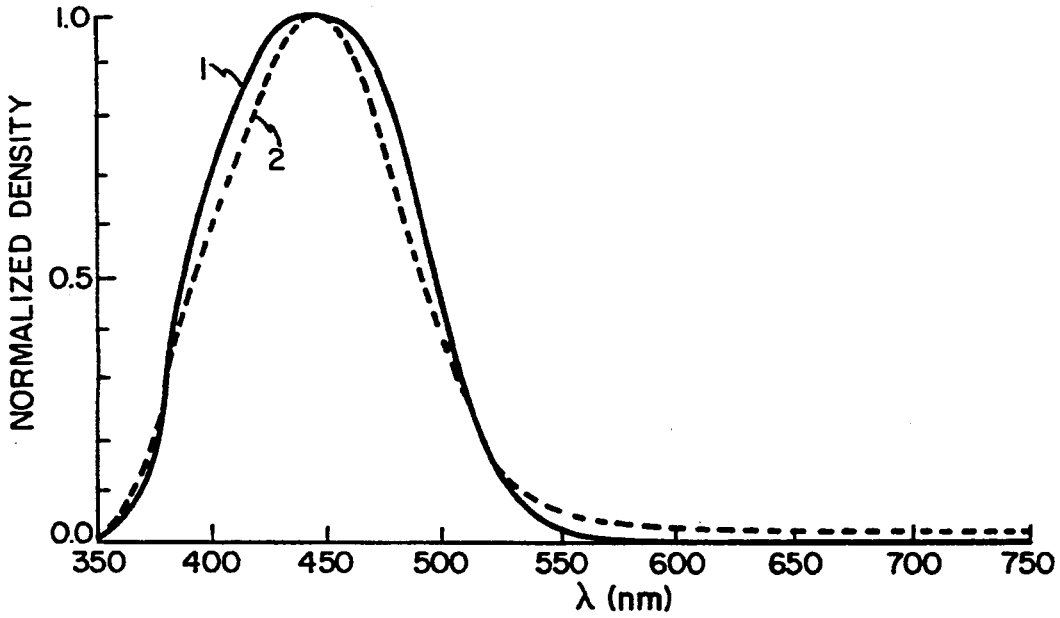
FIG. 2. Reflection spectra of dye thermally transferred to receiver for coatings of Examples 1 (curve 1 for dye obtained from polymeric coupler Y2) and 2 (curve 2 for dye obtained from conventional coupler Y4).

Several additional sets of these coatings were processed as described above, except that they were passed through the aforesaid pinch rollers ten times before stripping the donor layers from the receiver/base element. Regions of these strips were then read by reflectance spectroscopy to obtain visible spectra of the transferred dye. These spectra are illustrated in FIG. 2.

TABLE 1

Coupler Y3 and Dye Distribution

| Coating | Region | Donor/Receiver | Coupler Y3 ($mg/m^2$) | Dye ($mg/m^2$) |
|---|---|---|---|---|
| Example 1 (Comparison) | Dmin | Donor | 433 | 0 |
| | | Receiver | 551 | 0 |
| | Dmax | Donor | 350 | 48 |
| | | Receiver | 466 | 87 |
| Example 2 (Present Invention; Y2) | Dmin | Donor | 0 | 0 |
| | | Receiver | 0 | 0 |
| | Dmax | Donor | 0 | 149 |
| | | Receiver | 0 | 292 |

Curve 1 in FIG. 2 corresponds to the comparison coating of Example 1, which comprises the conventional coupler Y3. This curve was obtained at a reflectance density Dmax of 0.24. Curve 2 in FIG. 2 corresponds to the coating of the present invention, Example 2, comprising polymeric coupler Y2. This curve was obtained at a reflectance density Dmax of 0.45. The long wavelength absorption evident in curve 1 provides a brownish discoloration to the hue obtained, relative to that obtained in curve 2 for the polymeric coupler generated dye of the present invention. Some of these additional sets of processed coatings, including both the separated donor and receiver elements, were analyzed by extracting punches taken from Dmax and Dmin regions. These extracts were analyzed by HPLC to determine the amount of coupler and dye present; the results are shown in Table 1. The same dye is generated by coupler Y3 and by polymeric coupler Y2. In the comparison Example 1, 135 $mg/m^2$ of dye remained in the donor and receiver layers after thermal dye transfer processing, and in the Example 2 of the present invention, 441 $mg/m^2$ of dye remained in the donor and receiver elements after dye transfer. These extraction results corroborate the Dmax densitometry illustrated in FIG. 1, and show that the polymeric coupler Y2 is significantly more active than the conventionally dispersed coupler Y3. Table 1 also dramatically illustrates the distribution of coupler Y3 and dye among the donor and receiver layers after thermal transfer. In the Drain region of Example 1, more coupler Y3 ends up in the receiver layer than in the donor. In the Dmax region of Example 1, a comparable amount of coupler Y3 is transferred to the receiver. In Example 2, however, there is no monomeric coupler to be transferred to the receiver, since dye is formed by reaction of oxidized developer with polymeric coupler Y2.

EXAMPLES 3–4

Preparation of Polymeric Yellow Coupler (Y4)

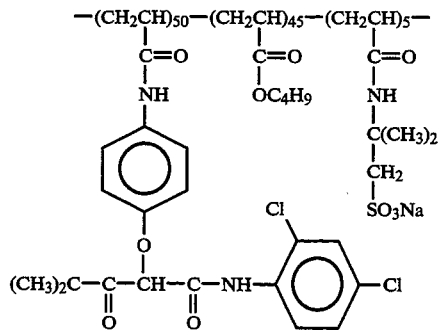

(Y4)

About 5 g of Y1, about 4.5 g of butyl acrylate, about 0.5 g of N-acrylamido-2,2'-dimethylpropane sulfonic acid (sodium salt), and about 40 mL of N,N-dimethylformamide were mixed in a 3-neck 100-mL roundbottom flask. The flask was immersed in a constant temperature bath at 80° C. and purged with nitrogen for 30 min. About 0.25 g of 2,2'-azobis(2-methylpropionitrile) was then added, and the polymerization was continued for about 4 h. The polymer solution was then diluted with about 120 mL of methanol and then dispersed into about 300 mL of hot water (about 70° C.) with vigorous stirring. The resulting latex was then concentrated to 3.63% solids with an Amicon ultrafiltration unit. The z-average particle size measured with a Malvern Autosizer IIC was 59 nm. The elemental analysis results were: C (60.1%); H (6.79%); N (3.66%).

Preparation of Test Coatings

A test coating structure and format identical to that described above for Examples 1 and 2 was utilized, except that lower levels of coupler Y3 (859 $mg/m^2$; Example 3) and polymeric coupler Y4 (1.11 $g/m^2$; a molar equivalent of coupling sites relative to the coated level of Y3, Example 4) were coated. The same coating support and receiver were utilized.

TABLE 2

Coupler Y3 and Yellow Dye Transferred to Receiver

| Coating | Region | Coupler Y3 ($mg/m^2$) | Dye ($mg/m^2$) |
|---|---|---|---|
| Example 3 (Comparison) | Dmin | 419 | 29 |
| | Dmax | 268 | 143 |
| Example 4 (Present Invention; Y4) | Dmin | 0 | 10 |
| | Dmax | 0 | 178 |

An identically prepared thermal solvent dispersion of p-hydroxy-2-ethylhexyl benzoate was used, and this thermal solvent was coated at the same level of 1.07 $g/m^2$. This same level of gelatin was coated in the first and second (overcoat) layers, and the same hardener, MBSE, was coated identically, as described earlier, to crosslink the gelatin.

Evaluation

Figure 3:
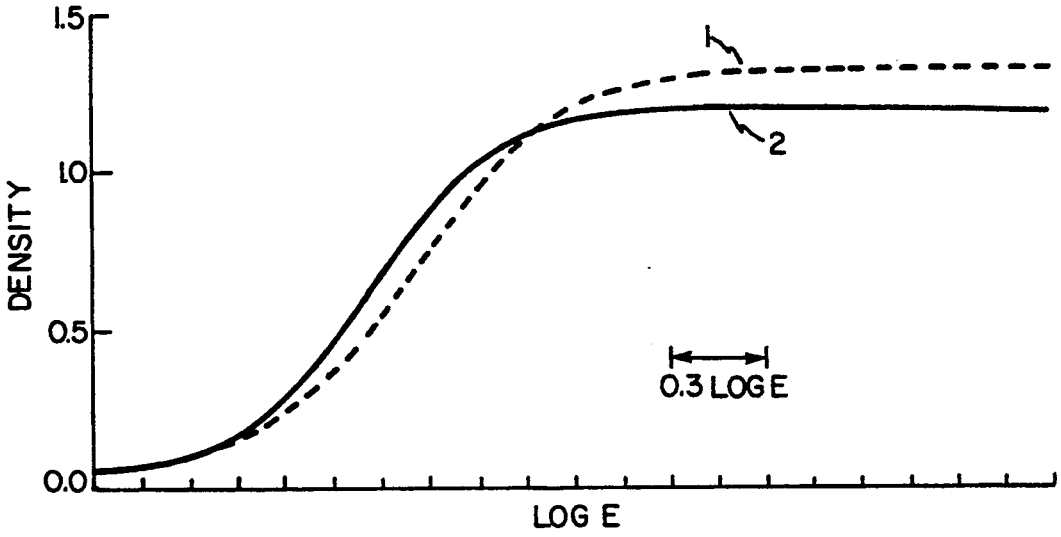
FIG. 3. Status A reflectance densitometry of test receiver elements obtained for the polymeric coupler Y4 (curve 1) of the present invention and for the comparison coupler Y3 (curve 2).

Several sets of these coatings were exposed and processed as described above for Examples 1 and 2; the same wet development solution, stop bath, buffer bath, and wash sequence was used. Thermal transfer was then activated by passing these test coatings through the heated pinch rollers at 110° C. ten times as earlier described. The silver halide and dye forming layer and overcoat were removed using the adhesion sheet stripping method described above. The receiver elements were then examined by status A densitometry (FIG. 3) and by HPLC extraction analysis for transferred coupler Y3 and transferred dye. The densitometry illustrated in FIG. 3 shows that the polymeric coupler Y4 yields a higher Dmax than does the conventional dispersion of the coupler Y3. Both Y3 and Y4 produce the same dye on reaction with the oxidized developer.

HPLC analysis of the Drain and Dmax regions of these coatings for transferred coupler Y3 and for transferred dye is illustrated in Table 2. The comparison coating of Y3 (Example 3) yielded substantial coupler transferred in both the Dmin and Dmax regions. This transfer of coupler was not observed in the coating of the present invention (Example 4), due to the immobility of the polymeric coupler Y4 and the lack of Y3 in the test coating. Dye was transferred in both of these coatings. The coating of this invention (Example 4) yielded a higher level of transferred dye in the Dmax region and a lower level in the Drain region.

EXAMPLES 5-6

Preparation of Cyan Monomer (C1)

The structure of monomer C1 is identical to that of monomer c-i shown earlier in the specification. About 34.8 g (0.16 mol) of 1,4-dihydroxy-N-methyl-2-naphthalenecarboxamide, about 25 g (0.16 mol) of 2-fluoro-5-nitroaniline, and about 100 mL of dry dimethylfonnamide (DMF) were placed in a 500-mL three-necked flask set in an ice bath. The mixture was cooled under nitrogen to about 0° to 5° C. About 9.6 g (0.32 mol) of sodium hydride (as an 80% by weight dispersion in mineral oil) was slowly added in portions over the course of about an hour, with intervals between additions to allow foaming to subside. The mixture was stirred overnight at room temperature, during which time the reaction went to completion. The mixture was drowned in about 600 mL of dilute HCl ice water. The solid was collected and washed with water, and dried in a vacuum oven at 55° C. to yield 55 g of the crude product. This crude was recrystallized form a 20:1 mixture of acetonitrile and tetrahydrofuran (THF) to yield about 32 g of intermediate v.

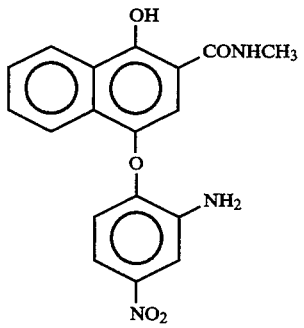

(v)

About 20 g (0.0566 mol) of intermediate v, about 7.0 g (0.0577 mol) of N,N-dimethylaniline, and about 150 mL of dry THF were added to a 500-mL three-necked flask set in an ice bath. The mixture was cooled under nitrogen to about 0° C. and about 5.2 g (0.0577 mol) of acryloyl chloride in about 10 mL of dry THF was slowly added fi-om a dropping funnel, while keeping the temperature below about 5° C. The addition took about 15 to 20 minutes. The reaction mixture was stirred cold for about 2 hours, while the reaction went to completion. The reaction mixture was drowned into about a liter of ice water (to which about 2 to 3 mL of concentrated HCl was added prior to drowning). The solid was stirred for about 15 minutes, and then collected and washed with water. The product was dried overnight at 55° C., and then recrystallized twice from 20 parts by weight acetonitrile with a small amount of THF to yield 18 g of monomer C1.

Preparation of Polymeric Cyan Coupler (C2)

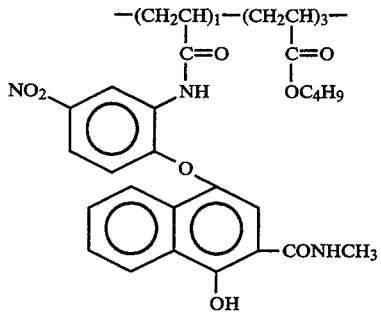

(C2)

About 200 g deionized water, about 2.64 g of 20% (w/w) sodium N-methyl-N-oleoyltaurate (Igepon T-77), and about 20 g of acetone were mixed in a 500 mL 4-neck roundbottom flask equipped with a mechanical stirrer, nitrogen inlet, and condenser. The flask was immersed in a constant temperature bath at 80° C. and heated for 30 rain with nitrogen purging. A monomer solution comprising about 4.074 g (0.01 mol) of C1, about 3.846 g of butyl acrylate (0.03 mol), and about 100 mL of N,N-dimethylformamide was prepared. About 3.16 g of 5% (w/w) aqueous ammonium persulfate was added to the reactor and stirred for 3 min. The monomer solution was then pumped into the reactor over 22 h, and the polymerization was continued for one hour. The resulting latexsuspension of C2 was cooled, filtered, and dialyzed against distilled water overnight. The latex was then concentrated to 2.53% solids with an Amicon ultrafiltration unit. The z-average particle size measured with a Malvern Autosizer IIC was about 49 nm. The elemental analysis results were: C (60.88%); H (7.28%); N (6.21%).

Preparation of Comparison Coupler (C3) Dispersion

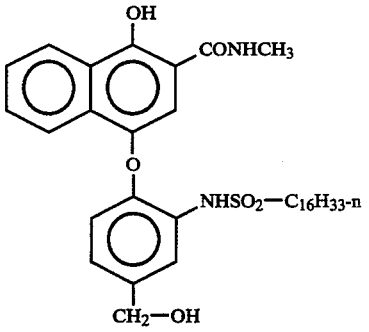

(C3)

About 8 g of C3 were dissolved in about 24 g of ethyl acetate at about 60° C. An aqueous gelatin solution comprising about 3.2 g of 10% (w/w) Alkanol-XC. about 19.2 g 12.5% (w/w) aqueous gelatin, and about 19.2 g water was prepared. These aqueous and ethyl acetate solutions were then combined with stirring and passed through a colloid mill five times to obtain a fine particle dispersion of C3. The resulting dispersion was chill set, noodled, and washed for about 4 h to remove the ethyl acetate. This dispersion was then remelted, chill set, and stored until use.

Preparation of Test Coatings

A test coating structure and format identical to that described above for Examples 1 and 2 was utilized, except that lower levels of coupler C3 (537 mg/m$^2$; Example 5) and polymeric coupler C2 (579 mg/m$^2$; a molar equivalent of coupling sites relative to the coated level of C3, Example 5) were coated. The same coating support and receiver were utilized. An identically prepared thermal solvent dispersion of p-hydroxy-2-ethylhexyl benzoate was used, and this thermal solvent was coated at the same level of 1.07 g/m$^2$. This same level of gelatin was coated in the first and second (overcoat) layers, and the same hardener, MBSE, was coated identically, as described earlier, to crosslink the gelatin.

Evaluation

Figure 4:
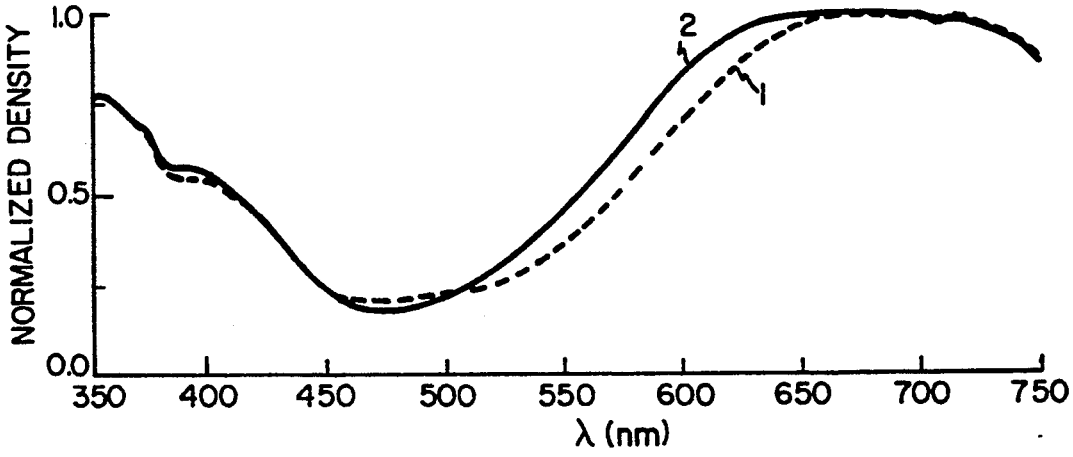
FIG. 4. Status A reflectance densitometry of test receiver elements obtained for the polymeric coupler C2 (curve 1) of the present invention and for the comparison coupler C3 (curve 2).
Figure 5:
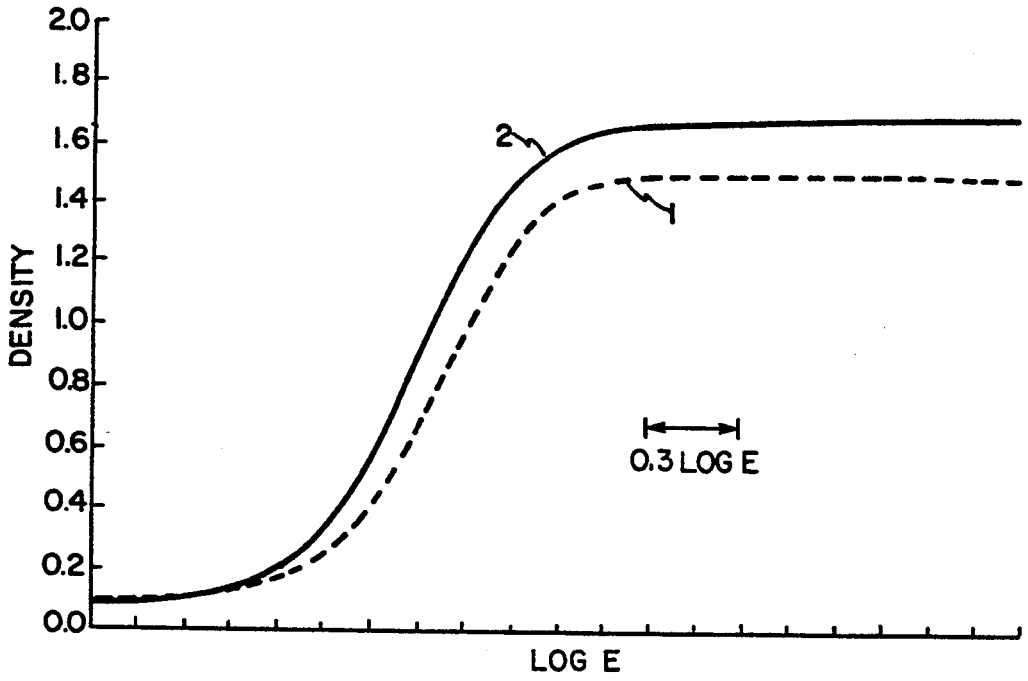
FIG. 5. Reflectance spectra of dye thermally transferred to receiver for coatings of dye obtained from polymeric coupler C2 (curve 1) and from conventional coupler C3 (curve 2).

Several sets of these coatings were exposed and processed as described above for Examples 1 and 2; the same wet development solution, stop bath, buffer bath, and wash sequence was used. Thermal transfer was then activated by passing these test coatings through the heated pinch rollers at 110° C. ten times as earlier described. The silver halide and dye forming layer and overcoat were removed using the adhesion sheet stripping method described above. The receiver elements were then examined by status A densitometry (FIG. 4), reflectance spectroscopy (FIG. 5), and by HPLC extraction analysis for transferred coupler C3 and transferred dye. The densitometry illustrated in FIG. 4 shows that the polymeric coupler C2 yields a lower Dmax than does the conventional dispersion of the coupler C3. Both C2 and C3 produce the same cyan dye on reaction with the oxidized developer. Note in FIG. 5, however, that the dye transferred in the comparison coating of Example 5 has a distinctly hypsochromically shifted short wavelength absorption edge. This shift yields a hue that is much more blue than is the cyan hue of the dye transferred in Example 6, from the polymeric coupler C2 of the present invention.

HPLC analysis of the Dmin and Dmax regions of these coatings for transferred coupler C3 and for transferred dye is illustrated in Table 3. The comparison coating of C3 (Example 5) yielded substantial coupler transferred in both the Dmin and Dmax regions. This transfer of coupler was not observed in the coating of the present invention (Example 6), due to the immobility of the polymeric coupler C2 and the lack of C3 in the test coating. Dye was transferred in both of these coatings. The coating of this invention (Example 6) yielded a higher level of transferred dye in the Dmax region. The apparently higher Dmax observed in the comparison coating of Example 5, illustrated as curve I in FIG. 4, may be attributed to the effectively wider absorption band and the bandwidth of the filters used in status A densitometry. The significant difference in hue illustrated in curves 1 and 2 in FIG. 5 may be attributed to the effects of the coupler (C3) transferred to the receiver in Example 5.

TABLE 3

Coupler C3 and Cyan Dye Transferred to Receiver

| Coating | Region | Coupler C3 (mg/m$^2$) | Dye (mg/m$^2$) |
|---|---|---|---|
| Example 5 | Dmin | 166 | 0.6 |
| (Comparison; C3) | Dmax | 56 | 163 |
| Example 6 | Dmin | 0 | 2.3 |
| (Present Invention; C2) | Dmax | 0 | 196 |

EXAMPLES 7–9

Preparation of Polymeric Cyan Coupler (C4)

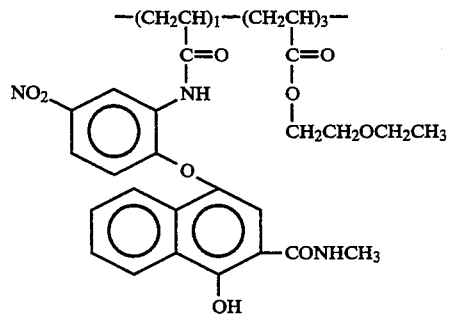

(C4)

About 300 g deionized water, about 3.96 g of 20% (w/w) sodium N-methyl-N-oleoyltaurate (Igepon T-77), and about 20 g of acetone were mixed in a 500 mL 4-neck roundbottom flask equipped with a mechanical stirrer, nitrogen inlet, and condenser. The flask was immersed in a constant temperature bath at 80° C. and heated for 30 min with nitrogen purging. A monomer solution comprising about 6.22 g (0.015 mol) of C1, about 6.487 g of ethoxyethyl acrylate (0.045 mol), and about 150 mL of N,N-dimethylformamide was prepared. About 3.16 g of 5% (w/w) aqueous ammonium persulfate was added to the reactor and stirred for 3 min. The monomer solution was then pumped into the reactor over 7 h, and the polymerization was continued for one hour. The resulting latex was cooled, filtered, and dialyzed against distilled water overnight. The latex was then concentrated to 4.33% solids with an Amicon ultrafiltration unit. The z-average particle size measured with a Malvern Autosizer IIC was about 81 nm. The elemental analysis results were: C (60.06%); H (6.6%); N (6.43%).

Preparation of Polymeric Cyan Coupler (C5)

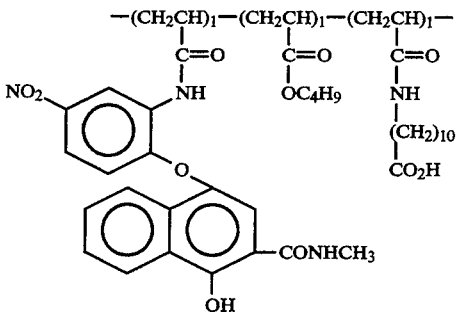

(C5)

About 250 g deionized water, about 6 g of 20% (w/w) sodium N-methyl-N-oleoyltaurate (Igepon T-77), and about 20 g of acetone were mixed in a 500 mL 4-neck roundbottom flask equipped with a mechanical stirrer, nitrogen inlet, and condenser. The flask was immersed in a constant temperature bath at 80° C. and heated for 30 rain with nitrogen purging. A monomer solution comprising about 6.11 g (0.015 mol) of C1, about 1.92 g of butyl acrylate (0.015 mol), about 3.83 g (0.015 mol) N-acrylamidoundecanoic acid, and about 150 mL of N,N-dimethylformamide was prepared. About 4.7 g of 5% (w/w) aqueous ammonium persulfate was added to the reactor and stirred for 3 min. The monomer solution was then pumped into the reactor over 7 h, and the polymerization was continued for one hour. A solution comprising about 3 g of 20% (w/w) sodium N-methyl-N-oleoyltaurate, about 2.4 g of 5% ammonium persulfate, and about 50 mL of deionized water was then added over 6 h, and the reaction was allowed to continue for an additional hour. The resulting latex was cooled, filtered, and dialyzed against distilled water overnight. The latex was then concentrated to 5.06% solids with an Amicon ultrafiltration unit. The z-average particle size measured with a Malvern Autosizer IIC was about 49 nm. The elemental analysis results were: C (62.89%); H (7.95%); N (6.45%).

Preparation of Test Coatings

A test coating structure and format identical to that described above for Examples 5 and 6 was utilized; and polymeric couplers C4 (562 mg/m$^2$; Example 8) and C5 (738 mg/m$^2$; Example 9) were coated at a molar equivalent of coupling sites, relative to the coated level of C3 (537 mg/m$^2$) in Example 7. The same coating support and receiver were utilized. An identically prepared thermal solvent dispersion of p-hydroxy-2-ethylhexyl benzoate was used, and this thermal solvent was coated at the same level of 1.07 g/m$^2$. This same level of gelatin was coated in the first and second (overcoat) layers, and the same hardener, MBSE, was coated identically, as described earlier, to crosslink the gelatin.

Evaluation

Several sets of these coatings were exposed and processed as described above for Examples 5 and 6; the same wet development solution, stop bath, buffer bath, and wash sequence were used. Thermal transfer was then activated by passing these test coatings through the heated pinch rollers at 110° C. ten times as earlier described. The silver halide and dye forming layer and overcoat were removed using the adhesion sheet stripping method described above. HPLC analysis of the Dmin and Dmax regions of the donor and receiver elements from these coatings for transferred coupler C3 and for transferred dye is illustrated in Table 4. The comparison coating of C3 (Example 7) yielded substantial coupler transferred in both the Dmin and Dmax regions. This transfer of coupler was not observed in the coatings of the present invention (Examples 8 and 9), due to the immobility of the polymeric couplers C4 and C5 and the lack of C3 in these test coatings.

TABLE 4

Coupler C3 and Cyan Dye Distribution

| Coating | Region | Donor/Receiver | Coupler C3 (mg/m$^2$) | Dye (mg/m$^2$) |
|---|---|---|---|---|
| Example 7 | Dmin | Donor | 255 | <1.1 |
| (Comparison; | | Receiver | 257 | <1.1 |
| C3) | Dmax | Donor | 49 | 171 |
| | | Receiver | 24 | 183 |
| Example 8 | Dmin | Donor | 0 | <1.1 |
| (Present | | Receiver | 0 | 04.6 |
| Invention; | Dmax | Donor | 0 | 74 |
| C4 | | Receiver | 0 | 211 |
| Example 9 | Dmin | Donor | 0 | 2.9 |
| (Present | | Receiver | 0 | 4.6 |
| Invention; | Dmax | Donor | 0 | 66 |
| C5) | | Receiver | 0 | 161 |

EXAMPLES 10–11

Preparation of Magenta Monomer (M1)

The structure of monomer M1 is identical to that of monomer m-ii shown earlier in the specification. To a solution of coupler vi (about 20 g, 51.4 mmol) and the disulfide vii (about 12.5 g, 28.4 mmol) in about 100 mL of DMF at room temperature was added a solution of bromine (1.45 mL, 28.3 mmol) in DMF (10 mL). This combined solution was warmed to 65° C. and stirred for 12 h, and then allowed to cool to room temperature. The mixture was slowly poured into 1L of ice water and the white precipitate was collected by suction filtration and dried to give about 35.2 g of intermediate viii.

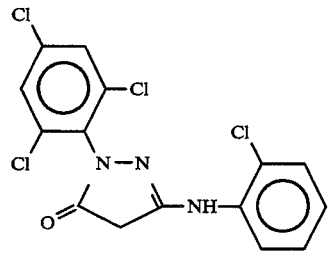

(vi)

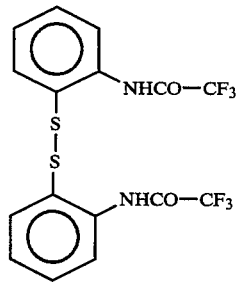

(vii)

-continued (viii)

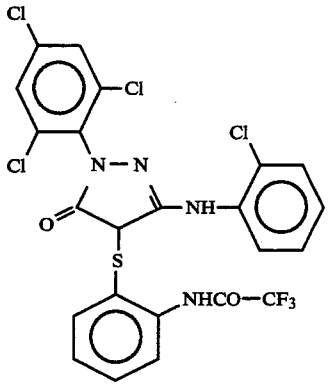

(ix)

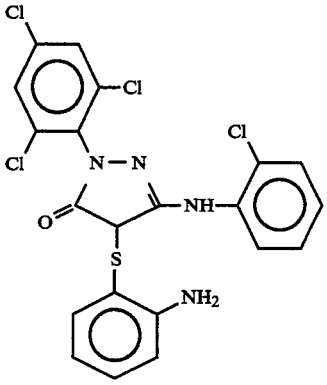

To a slurry of viii (30.3 g, 50 mmol) in 250 methanol was added KOH (28.0 g, 500 mmol) in water (25 mL). This mixture was refluxed for 7.5 h, cooled, and poured into about 500 mL of ice-cold 10% (w/w) aqueous HCl. The gray precipitate was collected by suction filtration, washed with about 500 mL of water, and dried to give about 25.5 g of crude ix. This material was then dissolved in about 500 mL of diethyl ether, dried over $MgSO_4$, filtered, concentrated, and crystallized. This material was then triturated with about 100 mL of hot diethyl ether, cooled, diluted with about 100 mL hexane, and the solid was then collected by suction filtration to give about 20.3 g of beige powder, ix. This material (20.3 g, 39.6 mmol) was dissolved in about 80 mL of dry THF (tetrahydrofuran) under argon at room temperature, and about 5.5 mL (43 mmol) of N,N-dimethylaniline was added. The stirred mixture was cooled in an ice water bath and a solution of acryloyl chloride (3.5 mL, 43 mmol) in dry THF (20 mL) was added over 5 minutes by dropping funnel. The bath was removed and the mixture was stirred at room temperature for 20 h. The mixture was then slowly poured into a vigorously stirred mixture of crushed ice (about 300 mL) and 25% HCl (about 200 mL). The greenish white solid was collected by suction filtration and dried under vacuum. This material was then purified by flash chromotography over silica gel, using ethyl acetate and ligroin mixtures to elute fractions. About 17.3 g of the desired monomer, M1, was obtained as a beige glass upon solvent removal.

Preparation of Polymeric Magenta Coupler (M2)

(M2)

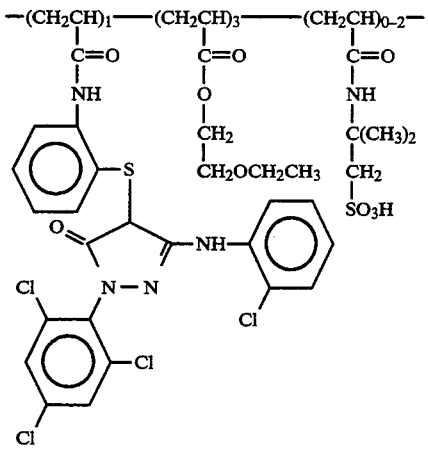

About 5.66 g (0.01 mol) of monomer M1, about 4.33 g (0.03 mol) of 2-ethoxyethyl acrylate, about 0.41 g (0.002 mol) of 2-acrylamido-2-methyl propanoic acid, and about 40 mL of DMF (dimethyl formamide) were mixed in a 100 mL 3-neck round bottom flask equipped with a nitrogen inlet, a mechanical stirrer, and a condenser. The flask was immersed in a constant temperature bath at 80° C. and purged with nitrogen for 30 minutes. About 0.26 g of AIBN (2,2'-azobis[2-methyl propionitrile]) in about 2 mL of DMF was added to initiate polymerization. After about 4 h about 0.13 g of additional AIBN was added. The polymerization was allowed to proceed at 80° C. for an additional 16 h. The polymer solution was diluted with about 150 mL of acetone and dispersed in about 900 mL of hot distilled water with agitation. A milky polymer dispersion of M2 was obtained. This dispersion was dialyzed against distilled water overnight and concentrated to 6.31% solids with an Amicon diafiltration unit. The z-average particle size measured with a Malvern Autosizer IIC was about 180 nm. The elemental analysis results were: C (45.74%); H (4.73%); N (6.21%); Cl (8.6%).

Preparation of Comparison Coupler (M3) Dispersion (M3)

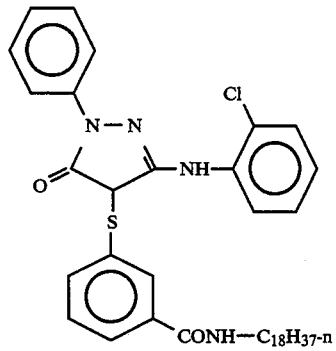

About 95 g of M3 were dissolved in about 28.5 g of ethyl acetate at about 60° C. An aqueous gelatin solution comprising about 3.8 g of 10% (w/w) Alkanol-XC, about 22.8 g 12.5% (w/w) aqueous gelatin, and about 30.4 g water was prepared. These aqueous and ethyl acetate solutions were then combined with stirring and passed through a colloid mill five times to obtain a fine particle dispersion of M3. The resulting dispersion was chill set, noodled, and washed for about 4 h to remove the ethyl acetate. This dispersion was then remelted, chill set, and stored until use.

Preparation of Test Coatings

A test coating structure and format nearly identical to that described above for Examples 1 and 2 was utilized. The same coating support and receiver were utilized. Polymeric coupler M2 (1035 mg/m$^2$; Example 11) was coated at a molar equivalent of coupling sites, relative to the coated level of M3 (687 mg/m$^2$) in Example 10. Blue sensitized silver chloride at a coverage of about 537 mg/m$^2$ was coated with polymeric coupler M2. Green sensitized silver chloride at a coverage of about 408 mg/m$^2$ was coated with coupler M3. A thermal solvent dispersion of p-hydroxy-2-ethylhexyl benzoate, prepared as described earlier, was used, and this thermal solvent was coated at a level of 687 mg/m$^2$ in the dye forming layer. Gelatin was coated at about 687 mg/m$^2$ in the light sensitive layers. The second (overcoat) layers, and the same proportion of hardener, MBSE, were coated identically as described earlier for Examples 1 and 2.

Evaluation

Several sets of these coatings were exposed and processed as described above for Examples 1 and 2; the same wet development solution, stop bath, buffer bath, and wash sequence were used. Thermal transfer was then activated by passing these test coatings through the heated pinch rollers at 110° C. ten times as earlier described. The silver halide and dye forming layer and overcoat were removed using the adhesion sheet stripping method described above. HPLC analysis of the Dmin and Dmax regions of the receiver elements from these coatings for transferred dye is illustrated in Table 5. The coating of the present invention, containing the polymeric magenta coupler M2 (Example 11), yielded substantially more transferred dye (32.4%) than the comparison coating of M3 (Example 10).

The invention has been described in detail with particular reference to preferred embodiments thereof, but it will be understood that variations and modifications can be effected within the spirit and scope of the invention.

TABLE 5

Magenta Dyes Transferred to Receiver

| Coating | Region | Dye in Receiver (mg/m$^2$) |
|---|---|---|
| Example 10 | Dmin | 0.2 |
| (Comparison; M3) | Dmax | 17.9 |
| Example 11 | Dmin | 0.1 |
| (Present Invention; M2) | Dmax | 23.7 |

What is claimed is:

1. A process for forming a dye image comprising the steps of:

exposing a photographic element comprising one and only one support bearing a light sensitive silver halide emulsion layer containing a polymeric color coupler compound capable of forming a heat transferable dye upon development, wherein the polymeric color coupler compound is of the formula:

COUP-L-B wherein COUP represents a coupler moiety capable of forming a heat transferable dye upon reaction of the moiety with an oxidation product of a color developer; L is a divalent linking group which is separated from COUP upon reaction of the coupler moiety with said oxidation product of a color developer; and B represents the polymeric backbone;

developing said exposed element in an external color developer solution to form a heat transferable dye image;

stopping said development with an acid stop bath;

heating said exposed, developed element to thereby transfer the dye image from the emulsion layer to a dye receiving layer, wherein said receiving layer is part of the photographic element or part of a separate dye receiving element brought into contact with the photographic element; and separating the emulsion layer from the dye receiving layer containing the transferred dye image.

2. The process of claim 1, wherein said color developer solution comprises a p-phenylenediamine.

3. The process of claim 2, wherein said color developer solution comprises 4-amino-N,N-diethylaniline hydrochloride; 4-amino-3-methyl-N,N-diethylaniline hydrochloride; 4-amino-3-methyl-N-ethyl-N-(β-methanesulfonamidoethyl)aniline sulfate hydrate; 4-amino-3-methyl-N-ethyl-N-(β-hydroxyethyl)aniline sulfate; 4-amino-3-(β-methanesulfonamido)ethyl-N,N-diethylaniline hydrochloride; 4-amino-3-methyl-N-ethyl-N-(β-methanesulfonamidoethyl)aniline sesquisulfate monohydrate; or 4-amino-3-methyl-N-ethyl-N-(2-methoxyethyl)aniline di-p-toluenesulfonic acid.

4. The process of claim I wherein said dye receiving layer comprises polycarbonate, polyurethane, polyester, polyvinyl chloride, poly(styrene-coacrylonitrile), poly(caprolactone) or mixtures thereof.

5. The process of claim I wherein said dye receiving layer is an integral layer of said photographic element.

6. The process of claim 5, wherein said dye receiving layer is present between the support and the emulsion layer of the photographic element, and wherein after the dye image is transferred from the emulsion layer to the dye receiving layer, the emulsion layer is separated from the dye receiving layer.

7. The process of claim 1, wherein said dye receiving layer is contained in a separate dye receiving element, and further comprising the step of bringing together the dye receiving element and the photographic element prior to or during heating step (c).

8. The process of claim 1, wherein said heating step comprises exposing the photographic element to a temperature of from 50° C. to 200° C. for from 10 seconds to 30 minutes.

9. The process of claim 8, wherein said heating step comprises exposing the photographic element to a temperature of from 75° C. to 160° C. for from 10 seconds to 30 minutes.

10. The process of claim 9, wherein said heating step comprises exposing the photographic element to a temperature of from 80° C. to 120° C. for from 10 seconds to 30 minutes.

11. The process of claim 1, wherein said heating step comprises running said photographic element and said receiving layer through rollers at a temperature of 75° C. to 190° C., a pressure of 500 Pa to 1,000 kPa, and a speed of 0.1 cm/s to 50 cm/s.

12. The process of claim 1, wherein said COUP moiety is of the phenol type (formula C-I) or the naphthol type (formulae C-II and C-III) or of the type C-IV as presented in the formulae below; wherein the asterisk mark indicates the position of the bond to said divalent linking group L;

C-I

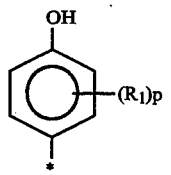

C-II

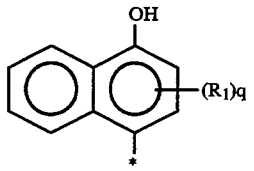

C-III

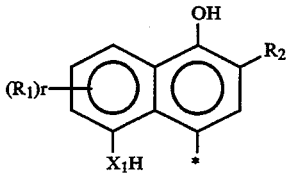

C-IV

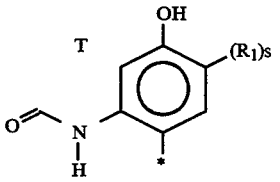

and wherein $R_1$ has 0 to 30 carbon atoms and represents a possible substituent on the phenol ring or naphthol ring;

$R_2$ represents —$CONR_3R_4$, —$NHCOR_3$, —$NHCOOR_5$, $NHSO_2R_5$, —$NHCONR_3R_4$, or $NHSO_2R_3R_4$, $R_3$ and $R_4$ each independently represents a hydrogen atom, aliphatic group having 1 to 30 carbon atoms, aromatic group having from 6 to 30 carbon atoms, or heterocyclic group having fro 2 to 30 carbon atoms;

$R_5$ represents an aliphatic group having from 1 to 30 carbon atoms, aromatic group having from 6 to 30 carbon atoms, or heterocyclic group;

$R_3$ and $R_4$ may join each other to form a heterocyclic ring; p is an integer form 0 to 3; q and r are integers from 0 to 4; s is an integer from 0 to 2;

$X_1$ represents an oxygen atom, sulfur atom, or $R_6N<$-group, where $R_6$ represents a hydrogen atom, an aliphatic group having from 1 to 30 carbon atoms, an aromatic group having from 6 to 30 carbon atoms, a heterocyclic group having from 2 to 30 carbon atoms, a carbonamido group having from 1 to 30 carbon atoms, an imido group having from 4 to 30 carbon atoms, —$OR_7$, —$SR_7$, —$COR_7$. —$CONR_7R_8$, —$COCOR_7$, —$COCOR_7R_8$, —$COOR_7$, —$COCOOR_9$, —$SO_2R_9$, —$SO_2OR_9$, —$SO_2NR_7R_8$, or —$NR_7R_8$; where $R_7$ and $R_8$ each independently represent a hydrogen atom, an aliphatic group having from 1 to 30 carbon atoms, an aromatic group having from 6 to 30 carbon atoms, or a heterocyclic group having from 2 to 30 carbon atoms; $R_7$ and $R_8$ may join each other to form a heterocyclic ring; $R_9$ represent an aliphatic group having from 1 to 30 carbon atoms, an aromatic group having from 6 to 30 carbon atoms, or a heterocyclic group having from 2 to 30 carbon atoms;

T represents a group of atoms required to form a 5-, 6-, or 7-membered ring, wherein T is $$-O-,\ -\underset{R'}{\underset{|}{N}}-,\ -\underset{O}{\underset{\|}{C}}-,\ -S-,\ -N=,\ =N-,$$

$$-\underset{R'}{\underset{|}{C}}=,\ =\underset{R'}{\underset{|}{C}}-,\ \text{or}\ -\underset{R''}{\underset{|}{\overset{R'}{\overset{|}{C}}}}-,$$

or a combination thereof, and wherein R′ and R″ each independently represents a hydrogen atom, alkyl group, aryl group, halogen atom, alkyloxy group, alkyloxycarbonyl group, arylcarbonyl group, alkylcarbamoyl group, arylcarbamoyl group or cyano group.

13. The process of claim 12, wherein said $R_1$ is selected from the group comprising an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group, an arylureido group, hydroxyl group, amino group, carboxyl group, sulfo group, heterocyclic group, carbonamido group, sulfonamido group, carbamoyl group, sulfamoyl group, ureido group, acyloxy group, aliphatic oxy group, aliphatic thio group, aliphatic sulfonyl group, aromatic oxy group, aromatic thio group, aromatic sulfonyl group, sulfamoyl amino group, nitro group, and imido group.

14. The process of claim 12, wherein said $R_3$ and $R_4$ are each independently selected from the group comprising a hydrogen atom, methyl, ethyl, butyl, methoxyethyl, n-decyl, n-dodecyl, n-hexadecyl, trifluoromethyl, heptafluoropropyl, dodecyloxypropyl, 2,4-di-t-amylphenoxy-propyl, 2,4-di-t-amylphenoxybutyl, phenyl, tolyl, 2-tetradecyloxyphenyl, pentafluorophenyl, and 2-chloro-5-dodecyloxycarbonyl phenyl, 2-pyridyl, 4-pyridyl, 2-furyl, and 2-thienyl.

15. The process of claim 12, wherein said $R_5$ is selected from the group comprising methyl, ethyl, butyl, methoxyethyl, n-decyl, n-dodecyl, and n-hexadecyl, phenyl, tolyl, 4-chlorophenyl, naphthyl, 2-pyridyl, 4-pyridyl, and 2-furyl.

16. The process of claim 12, wherein said $R_3$ and $R_4$ may join each other to form a heterocyclic ring selected from the group comprising a morpholine ring, a piperidine ring, and a pyrrolidine ring.

17. The process of claim 12, wherein said $R_6$ is selected from the group comprising methyl, ethyl, butyl, methoxyethyl, benzyl, phenyl, tolyl, 2-pyridyl and 2-pyrimidyl, formamido, acetamido, N-methylacetamido, toluenesulfonarnido, and 4-chlorobenzenesulfonamido, succinimido.

18. The process of claim 12, wherein said $R_7$, $R_8$ and $R_9$ may independently be selected from the group comprising methyl, ethyl, butyl, methoxyethyl, n-decyl, n-dodecyl, n-hexadecyl, trifluoromethyl, heptafluoropropyl, dodecyloxypropyl, 2,4-di-t-amylphenoxypropyl, 2,4-di-t-amylphenoxybutyl, phenyl, tolyl, 2-tetradecyloxy phenyl, pentafluorophenyl, and 2-chloro-5-dodecyloxycarbonylphenyl, 2-pyridyl, 4-pyridyl, 2-furyl, and 2-thienyl.

19. The process of claim 12, wherein said $R_7$ and $R_8$ may join each other to form a heterocyclic ring selected from the group comprising a morpholine ring, a piperidine ring, and a pyrrolidine ring.

20. The process of claim 1, wherein said COUP moiety is of the pyrazolotriazole-type and imidazopyrazole-type (formulae M-I to M-VII presented below); the asterisk mark indicates the position of the bond to said divalent linking group L;

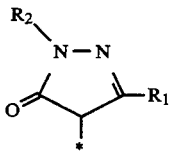

M-I

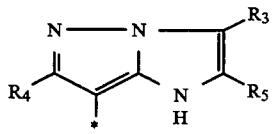

M-II

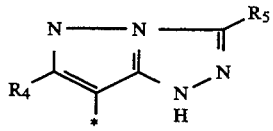

M-III

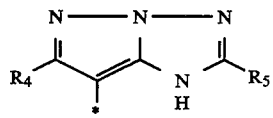

M-IV

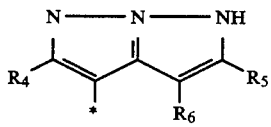

M-V

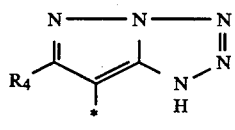

M-VI

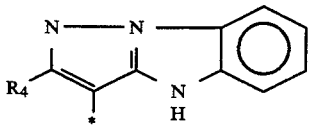

M-VII wherein $R_1$ and $R_2$ each independently represents a substituent selected from the group comprising alkyl, substituted alkyl, an aryl, substituted aryl, alkoxy, aryloxy, alkoxycarbonyl, acylamino, carbamoyl, alkylcarbamoyl group, dialkylcarbamoyl, arylcarbamoyl, alkylsulfonyl, arylsulfonyl, alkylsulfonamido, arylsulfonamido, sulfamoyl, alkylsulfamoyl, dialkylsulfamoyl, arylsulfamoyl, alkylthio group, arylthio, cyano, nitro, and a halogen atom;

$R_3$, $R_4$, $R_5$, and $R_6$ are each independently selected from the group comprising hydrogen atom, hydroxyl group, unsubstituted alkyl, substituted alkyl, aryl, heterocyclic, alkylamino, acylamino, anilino, alkoxycarbonyl, alkylcarbonyl, arylcarbonyl, alkylthio, arylthio, carbamoyl, sulfamoyl, and alkyl sulfonamido.

21. The process of claim 20, wherein $R_1$ and $R_2$ each independently is selected from the group comprising halo-alkyl, cyano-alkyl, benzyl-alkyl, methyl-aryl, ethyl-aryl, methoxy, ethoxy, phenoxy, methoxy carbonyl, acetylamino, methylcarbamoyl, ethylcarbamoyl, dimethylcarbamoyl, phenylcarbamoyl, methylsulfonyl, phenylsulfonyl, methanesulfonamido, phenylsulfonamido, ethylsulfamoyl, dimethylsulfamoyl, methylthio, phenylthio, fluorine atom, chlorine atom, and bromine atom.

22. The process of claim 20, wherein $R_3$, $R_4$, $R_5$, and $R_6$ are each independently selected from the group comprising methyl, propyl, t-butyl, trifluoromethyl, tridecyl, phenyl, 4-t-butylphenyl, 2,4-di-t-amylphenyl, 4-methoxyphenyl, 2-furyl, 2-thienyl, 2-pyrimidinyl, 2-benzthiazolyl, methylamino, diethylamino, t-butylamino, acetylamino, propylamido, benzamido, phenylamino, 2-chloroanilino, methoxycarbonyl, butoxycarbonyl, 2-ethylhexyloxycarbonyl, acetyl, butylcarbonyl, cyclohexylcarbonyl, benzoyl, 4-t-butylbenzoyl, methylthio, octylthio, 2-phenoxyethylthio, phenylthio, 2-butoxy-5-t-octylphenylthio, N-ethylcarbamoyl, N,N-dibutylcarbamoyl, N-methyl-N-butylcarbamoyl, N-ethylsulfamoyl, N,N-diethylsulfamoyl, N,N-dipropylsulfamoyl, benzenesulfonamido, and p-toluenesulfonamido.

23. The process of claim 1, wherein said photographic element further comprises a layer containing a thermal solvent.

24. An aqueous alkaline developable photographic element comprising one and only one support bearing a light sensitive silver halide emulsion layer, a layer containing a polymeric color coupler compound capable of forming a heat transferable dye upon development in an external alkaline color developer solution, a layer containing a thermal solvent for facilitating the diffusion of said dye, said layers further comprising a hydrophilic colloid, and further bearing between said support and said light sensitive layer a polymeric receive layer capable of absorbing said heat transferable dye upon thermal activation and diffusion of said dye, wherein said polymeric color coupler compound is of the formula:

COUP-L-B wherein COUP represents a coupler moiety capable of forming a heat transferable dye upon reaction of the moiety with the oxidation product of a color developing agent; L is a divalent linking group which is separated from COUP upon reaction of the coupler moiety with said oxidation product of said color developing agent; and B represents the polymeric backbone.

25. The element of claim 24, wherein said COUP moiety is of the phenol type (formula C-I) or the naphthol type (formulae C-II and C-III) or of the type C-IV as presented in the formulae below; wherein the asterisk mark indicates the position of the bond to said divalent linking group L;

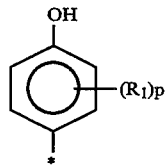

C-I

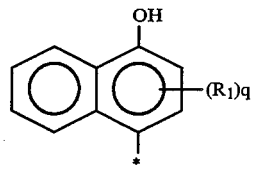

C-II

-continued

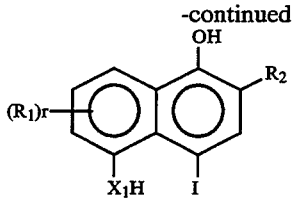

C-III

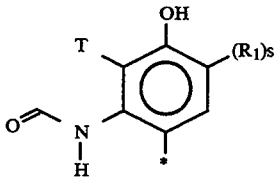

C-IV and wherein $R_1$ has 0 to 30 carbon atoms and represents a possible substituent on the phenol ring or naphthol ring;

$R_2$ represents —$CONR_3R_4$, —$NHCOR_3$, —$NHCOOR_5$, $NHSO_2R_5$, —$NHCONR_3R_4$, or $NHSO_2R_3R_4$, $R_3$ and $R_4$ each independently represents a hydrogen atom, aliphatic group having 1 to 30 carbon atoms, aromatic group having from 6 to 30 carbon atoms, or heterocyclic group having fro 2 to 30 carbon atoms;

$R_5$ represents an aliphatic group having from 1 to 30 carbon atoms, aromatic group having from 6 to 30 carbon atoms, or heterocyclic group;

$R_3$ and $R_4$ may join each other to form a heterocyclic ring; p is an integer form 0 to 3; q and r are integers from 0 to 4; s is an integer from 0 to 2;

$X_1$ represents an oxygen atom, sulfur atom, or $R_6N<$-group, where $R_6$ represents a hydrogen atom, an aliphatic group having from 1 to 30 carbon atoms, an aromatic group having from 6 to 30 carbon atoms, a heterocyclic group having from 2 to 30 carbon atoms, a carbonamido group having from 1 to 30 carbon atoms, an imido group having from 4 to 30 carbon atoms, —$OR_7$, —$SR_7$, —$COR_7$. —$CONR_7R_8$, —$COCOR_7$, —$COCOR_7R_8$, —$COOR_7$, —$COCOOR_9$, —$SO_2R_9$, —$SO_2OR_9$, —$SO_2NR_7R_8$, or —$NR_7R_8$; where $R_7$ and $R_8$ each independently represent a hydrogen atom, an aliphatic group having from 1 to 30 carbon atoms, an aromatic group having from 6 to 30 carbon atoms, or a heterocyclic group having from 2 to 30 carbon atoms; $R_7$ and $R_8$ may join each other to form a heterocyclic ring; $R_9$ represent an aliphatic group having from 1 to 30 carbon atoms, an aromatic group having from 6 to 30 carbon atoms, or a heterocyclic group having from 2 to 30 carbon atoms;

T represents a group of atoms required to form a 5-, 6-, or 7-membered ring, wherein T is $$-O-,\ -\underset{R'}{\underset{|}{N}}-,\ -\underset{O}{\underset{\|}{C}}-,\ -S-,\ -N=,\ =N-,$$

$$-\underset{R'}{\underset{|}{C}}=,\ =\underset{R'}{\underset{|}{C}}-,\ \text{or}\ -\overset{R'}{\overset{|}{\underset{R''}{\underset{|}{C}}}}-,$$

or a combination thereof, and wherein R′ and R″ each independently represents a hydrogen atom, alkyl group, aryl group, halogen atom, alkyloxy group, alkyloxycarbonyl group, arylcarbonyl group, alkylcarbamoyl group, arylcarbamoyl group or cyano group.

26. The element of claim 25, wherein said $R_1$ is selected from the group comprising an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group, an arylureido group, hydroxyl group, amino group, carboxyl group, sulfo group, heterocyclic group, carbonamido group, sulfonamido group, carbamoyl group, sulfamoyl group, ureido group, acyloxy group, aliphatic oxy group, aliphatic thio group, aliphatic sulfonyl group, aromatic oxy group, aromatic thio group, aromatic sulfonyl group, sulfamoyl amino group, nitro group, and imido group.

27. The element of claim 25, wherein said $R_3$ and $R_4$ are each independently selected from the group comprising a hydrogen atom, methyl, ethyl, butyl, methoxyethyl, n-decyl, n-dodecyl, n-hexadecyl, trifluoromethyl, heptafluoropropyl, dodecyloxypropyl, 2,4-di-t-amylphenoxy-propyl, 2,4-di-t-amylphenoxybutyl, phenyl, tolyl, 2-tetradecyloxyphenyl, pentafluorophenyl, and 2-chloro-5-dodecyloxycarbonyl phenyl, 2-pyridyl, 4-pyridyl, 2-furyl, and 2-thienyl.

28. The element of claim 25, wherein said $R_5$ is selected from the group comprising methyl, ethyl, butyl, methoxyethyl, n-decyl, n-dodecyl, and n-hexadecyl, phenyl, tolyl, 4-chlorophenyl, naphthyl, 2-pyridyl, 4-pyridyl, and 2-furyl.

29. The element of claim 25, wherein said $R_3$ and $R_4$ may join each other to form a heterocyclic ring selected from the group comprising a morpholine ring, a piperidine ring, and a pyrrolidine ring.

30. The element of claim 25, wherein said $R_6$ is selected from the group comprising methyl, ethyl, butyl, methoxyethyl, benzyl, phenyl, tolyl, 2-pyridyl and 2-pyrimidyl, formamido, acetamido, N-methylacetamido, toluenesulfonamido, and 4-chlorobenzenesulfonamido, succinimido.

31. The element of claim 25, wherein said $R_7$, $R_8$ and $R_9$ may independently be selected from the group comprising methyl, ethyl, butyl, methoxyethyl, n-decyl, n-dodecyl, n-hexadecyl, trifluoromethyl, heptafluoropropyl, dodecyloxypropyl, 2,4-di-t-amylphenoxypropyl, 2,4-di-t-amylphenoxybutyl, phenyl, tolyl, 2-tetradecyloxyphenyl, pentafluorophenyl, and 2-chloro-5-dodecyloxycarbonylphenyl, 2-pyridyl, 4-pyridyl, 2-furyl, and 2-thienyl.

32. The element of claim 25, wherein said $R_7$ and $R_8$ may join each other to form a heterocyclic ring selected from the group comprising a morpholine ring, a piperidine ring, and a pyrrolidine ring.

33. The element of claim 25, wherein said COUP moiety is of the pyrazolotriazole-type and imidazopyrazole-type (formulae M-I to M-VII presented below); the asterisk mark indicates the position of the bond to said divalent linking group L;

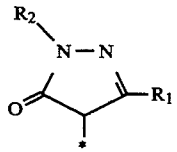

M-I

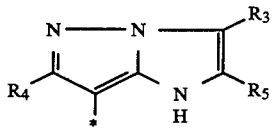

M-II

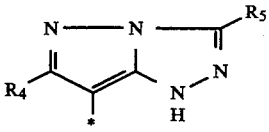

M-III

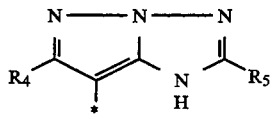

M-IV

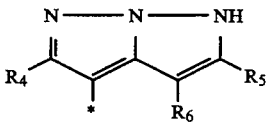

M-V

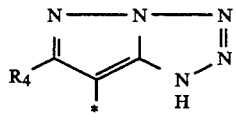

M-VI

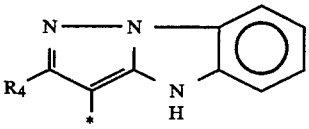

M-VII wherein $R_1$ and $R_2$ each independently represents a substituent selected from the group comprising alkyl, substituted alkyl, an aryl, substituted aryl, alkoxy, aryloxy, alkoxycarbonyl, acylamino, carbamoyl, alkylcarbamoyl group, dialkylcarbamoyl, arylcarbamoyl, alkylsulfonyl, arylsulfonyl, alkylsulfonamido, arylsulfonamido, sulfamoyl, alkylsulfamoyl, dialkylsulfamoyl, arylsulfamoyl, alkylthio group, arylthio, cyano, nitro, and a halogen atom;

$R_3$, $R_4$, $R_5$, and $R_6$ are each independently selected from the group comprising hydrogen atom, hydroxyl group, unsubstituted alkyl, substituted alkyl, aryl, heterocyclic, alkylamino, acylamino, anilino, alkoxycarbonyl, alkylcarbonyl, arylcarbonyl, alkylthio, arylthio, carbamoyl, sulfamoyl, and alkyl sulfonamido.

34. The element of claim 33, wherein $R_1$ and $R_2$ each independently is selected from the group comprising halo-alkyl, cyano-alkyl, benzyl-alkyl, methyl-aryl, ethyl-aryl, methoxy, ethoxy, phenoxy, methoxy carbonyl, acetylamino, methylcarbamoyl, ethylcarbamoyl, dimethylcarbamoyl, phenylcarbamoyl, methylsulfonyl, phenylsulfonyl, methanesulfonamido, phenylsulfonamido, ethylsulfamoyl, dimethylsulfamoyl, methylthio, phenylthio, fluorine atom, chlorine atom, and bromine atom.

35. The element of claim 34, wherein $R_3$, $R_4$, $R_5$, and $R_6$ are each independently selected from the group comprising methyl, propyl, t-butyl, trifluoromethyl, tridecyl, phenyl, 4-t-butylphenyl, 2,4-di-t-amylphenyl, 4-methoxyphenyl, 2-furyl, 2-thienyl, 2-pyrimidinyl, 2-benzthiazolyl, methylamino, diethylamino, t-butylamino, acetylamino, propylamido, benzamido, phenylamino, 2-chloroanilino, methoxycarbonyl, butoxycarbonyl, 2-ethylhexyloxycarbonyl, acetyl, butylcarbonyl, cyclohexylcarbonyl, benzoyl, 4-t-butylbenzoyl, methylthio, octylthio, 2-phenoxyethylthio, phenylthio, 2-butoxy-5-t-octylphenylthio, N-ethylcarbamoyl, N,N-dibutylcarbamoyl, N-methyl-N-butylcarbamoyl, N-ethylsulfamoyl, N,N-diethylsulfamoyl, N,N-dipropylsulfamoyl, benzenesulfonamido, and p-toluenesulfonamido.

36. The element of claim 24, wherein said hydrophilic colloid comprises gelatin, polyvinyl alcohol, or polyvinylpyrrolidone.

37. The element of claim 36, wherein said hydrophilic colloid is gelatin.

38. The element of claim 24, wherein said solvent is a phenol derivative.

39. The element of claim 38, wherein said thermal solvent is incorporated in a given layer in an amount of 1–300 % by weight of the total amount of hydrophilic binder incorporated in said layer.

40. The element of claim 24, wherein said polymeric receiver layer comprises polymer selected from the group comprising polycarbonates, polyurethanes, polyesters, polyvinyl chlorides, poly(styrene-co-acrylonitrile)s, poly(caprolactone)s and mixtures thereof.

41. The process of claim 1, wherein said COUP moiety is of the acylacetanilide type (formula Y-I) and benzoylacetanilide type (Formulae Y-II and Y-III) as presented below; the asterisk mark indicates the position of the bond to said divalent linking group L;

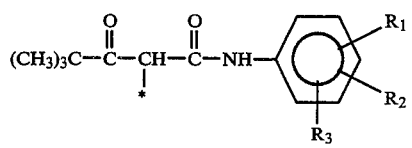

Y-I

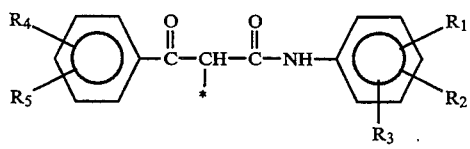

Y-II

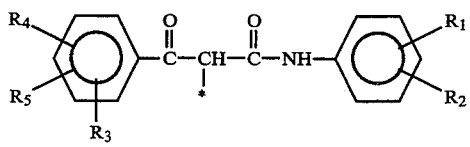

Y-III wherein $R_1$, $R_2$, $R_3$, $R_4$, and $R_5$ each independently are selected from the group comprising a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group, and thiocyano group.

42. The element of claim 24, wherein said COUP moiety is of the acylacetanilide type (formula Y-I) and benzoylacetanilide type (formulae Y-II and Y-III) as presented below; the asterisk mark indicates the position of the bond to said divalent linking group L;

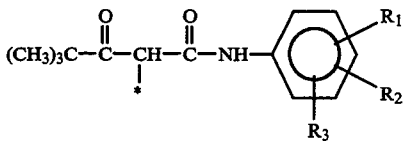

Y-I

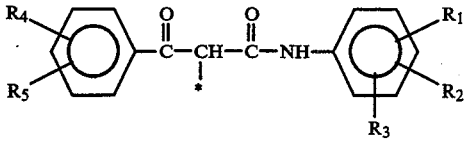

Y-II

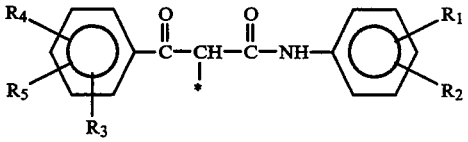

Y-III wherein $R_1$, $R_2$, $R_3$, $R_4$, and $R_5$ each independently are selected from the group comprising a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group, and thiocyano group.

43. A process for forming a dye image comprising the steps of:

exposing a photographic element comprising one and only one support bearing a light sensitive silver halide emulsion layer containing a polymeric color coupler compound capable of forming a heat transferable dye upon development, wherein the polymeric color coupler compound is of the formula:

COUP-L-B wherein COUP represents a coupler moiety capable of forming a heat transferable dye upon reaction of the moiety with an oxidation product of a color developer; L is a divalent linking group which is separated from COUP upon reaction of the coupler moiety with said oxidation product of a color developer; and B represents the polymeric backbone;

developing said exposed element in an external aqueous alkaline color developer solution to form a heat transferable dye image;

heating said exposed, developed element to thereby transfer the dye image from the emulsion layer to a dye receiving layer, where said receiving layer is part of the photographic element or part of a separate dye receiving element brought into contact with the photographic element; and separating the emulsion layer from the dye receiving layer containing the transferred dye image, and wherein bleaching, fixing, and bleach-fixing steps after the development step are excluded.

44. The process of claim 43, wherein said color developer solution comprises a p-phenylenediamine.

45. The process of claim 43 wherein said dye receiving layer comprises polycarbonate, polyurethane, polyether, polyvinyl chloride, poly(styrene-coacrylonitrile), poly(caprolactone) or mixtures thereof.

46. The process of claim 43 wherein said dye receiving layer is an integral layer of said photographic element.

47. The process of claim 43, wherein said dye receiving layer is present between the support and the emulsion layer of the photographic element, and wherein after the dye image is transferred from the emulsion layer to the dye receiving layer, the emulsion layer is separated from the dye receiving layer.

48. The process of claim 43, wherein said dye receiving layer is contained in a separate dye receiving element, and further comprising the step of bringing together the dye receiving element and the photographic element prior to or during heating step.

49. The process of claim 43, wherein said heating step comprises exposing the photographic element to a temperature of from 75° C. to 160° C. for from 10 seconds to 30 minutes.

50. The process of claim 43, wherein said heating step comprises exposing the photographic element to a temperature of from 80° C. to 120° C. for from 10 seconds to 30 minutes.

51. The process of claim 43, wherein said heating step comprises running said photographic element and said receiving layer through rollers at a temperature of 75° C. to 190° C., a pressure of 500 Pa to 1,000 kPa, and a speed of 0.1 cm/s to 50 cm/s.

52. The process of claim 43, wherein said photographic element further comprises a thermal solvent.

53. The process of claim 43, further comprising the step of stopping said development with an acid stop bath after development and before the heating step.

* * * * *

UNITED STATES PATENT AND TRADEMARK OFFICE

CERTIFICATE OF CORRECTION

PATENT NO. : 5,354,642

DATED : October 11, 1994

INVENTOR(S) : John Texter et al.

It is certified that error appears in the above-indentified patent and that said Letters Patent is hereby corrected as shown below:

Column 57, line 30,

" 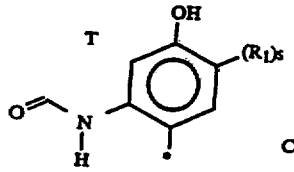 C-IV " should read -- 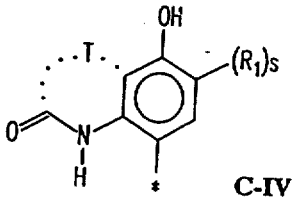 C-IV --

Column 59, line 22,

" 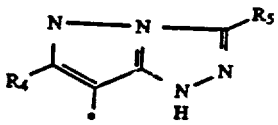 M-III " should read -- 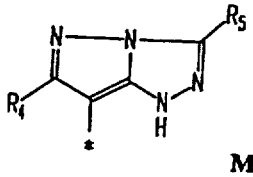 M-III --

Column 59, line 30

" 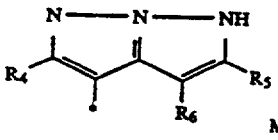 M-V " should read -- 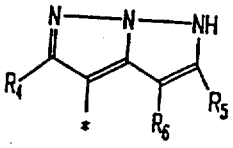 M-V --

UNITED STATES PATENT AND TRADEMARK OFFICE

CERTIFICATE OF CORRECTION

PATENT NO. : 5,354,642

DATED : October 11, 1994

INVENTOR(S) : John Texter et al.

It is certified that error appears in the above-indentified patent and that said Letters Patent is hereby corrected as shown below:

Column 59, line 37

" 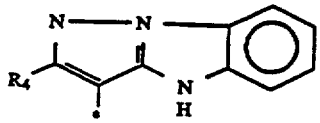 " should read -- 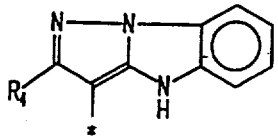 --

M-VII M-VII

Column 60, line 36, --receive-- should read "receiver".

Column 61, line 5

" 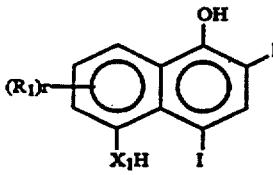 " should read -- 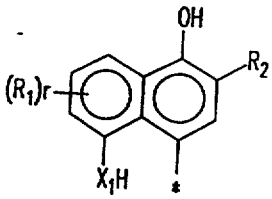 --

C-III C-III

UNITED STATES PATENT AND TRADEMARK OFFICE

CERTIFICATE OF CORRECTION

PATENT NO. : 5,354,642

DATED : October 11, 1994

INVENTOR(S) : John Texter et al.

It is certified that error appears in the above-indentified patent and that said Letters Patent is hereby corrected as shown below:

Column 61, line 15,

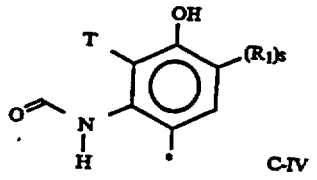

should read --

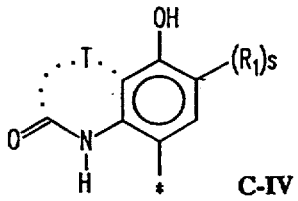

--

Signed and Sealed this

Eighteenth Day of July, 1995

*Attest:*

*Attesting Officer*

BRUCE LEHMAN

*Commissioner of Patents and Trademarks*